US006545434B2

(12) United States Patent
Sembhi et al.

(10) Patent No.: US 6,545,434 B2
(45) Date of Patent: Apr. 8, 2003

(54) MULTI-SCENE PRESET LIGHTING CONTROLLER

(75) Inventors: Tarvinder S. Sembhi, Harleysville, PA (US); Elliot G. Jacoby, Jr., Glenside, PA (US); Christopher J. Salvestrini, Emmaus, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 10/004,380

(22) Filed: Nov. 1, 2001

(65) Prior Publication Data

US 2002/0060530 A1 May 23, 2002

Related U.S. Application Data

(63) Continuation of application No. 09/220,632, filed on Dec. 24, 1998, now Pat. No. 6,380,696.

(51) Int. Cl.[7] ..... H05B 37/00

(52) U.S. Cl. ..... 315/312; 315/295; 315/158; 359/152

(58) Field of Search ..... 315/312, 291, 315/294, 307, 308, DIG. 4, 316–319, 292, 158, 149; 359/152, 154, 180, 189; 174/48, 49

(56) References Cited

U.S. PATENT DOCUMENTS

| | | | | | |
|---|---|---|---|---|---|
| 4,575,660 | A | | 3/1986 | Zaharchuk et al. | 315/295 |
| 4,649,323 | A | | 3/1987 | Pearlman et al. | 315/307 |
| 4,727,600 | A | * | 2/1988 | Avakian | 359/165 |
| 4,733,138 | A | | 3/1988 | Pearlman et al. | 315/307 |
| 4,889,999 | A | * | 12/1989 | Rowen | 307/115 |
| 4,893,062 | A | | 1/1990 | D'Aleo et al. | 315/291 |
| 4,924,151 | A | | 5/1990 | D'Aleo et al. | 315/295 |
| 5,030,893 | A | | 7/1991 | Spira et al. | 315/294 |
| 5,059,871 | A | | 10/1991 | Pearlman et al. | 315/316 |
| 5,170,068 | A | * | 12/1992 | Kwiatkowski et al. | 307/114 |
| 5,191,265 | A | * | 3/1993 | D'Aleo et al. | 315/295 |
| 5,248,919 | A | | 9/1993 | Hanna et al. | 315/291 |
| 5,336,979 | A | | 8/1994 | Watson et al. | 315/362 |
| 5,399,940 | A | | 3/1995 | Hanna et al. | 315/129 |
| 5,430,356 | A | | 7/1995 | Ference et al. | 315/291 |
| 5,455,490 | A | | 10/1995 | Callahan et al. | 315/194 |
| 5,463,286 | A | * | 10/1995 | D'Aleo et al. | 315/295 |
| 5,475,687 | A | | 12/1995 | Markkula, Jr. et al. | 709/224 |
| 5,485,058 | A | | 1/1996 | Watson et al. | 315/194 |
| 5,530,322 | A | | 6/1996 | Ference et al. | 315/295 |
| 5,598,042 | A | * | 1/1997 | Mix et al. | 307/112 |

(List continued on next page.)

FOREIGN PATENT DOCUMENTS

| | | |
|---|---|---|
| DE | 9321350 | 6/1997 |
| GB | 2051440 | 1/1981 |

OTHER PUBLICATIONS

1990 Honda Accord Owner's Manual, American Honda Motor Co., Inc.

*Primary Examiner*—Don Wong
*Assistant Examiner*—Ephrem Alemu
(74) *Attorney, Agent, or Firm*—Drinker Biddle & Reath

(57) ABSTRACT

A lighting control device for controlling the light intensity level of a least one lamp. The device is capable of storing preset light intensity levels in a memory. The method for storing the preset light intensity levels is simple and straight forward. The user adjusts the desired light intensity level using an intensity selector and then presses and holds a preset actuator for a non-transitory period of time to store the light intensity level into memory. A master control is capable of outputting control signals to adjacent lighting control devices located in the same wallbox through infrared signals or to lighting control devices located in a spaced wallbox through a flexible cable. The end of the flexible cable does not require connection to the wires of the lighting control devices in the spaced wallbox.

12 Claims, 25 Drawing Sheets

U.S. PATENT DOCUMENTS

| | | | | |
|---|---|---|---|---|
| 5,646,490 | A | 7/1997 | Carson et al. | 315/317 |
| 5,726,644 | A | 3/1998 | Jednacz et al. | 340/825.52 |
| 5,798,581 | A | 8/1998 | Keagy et al. | 307/115 |
| 5,808,417 | A | 9/1998 | Ference et al. | 315/112 |
| 5,814,950 | A | 9/1998 | Carson et al. | 315/317 |
| 5,821,704 | A | 10/1998 | Carson et al. | 315/317 |
| 5,867,017 | A | 2/1999 | Merwin et al. | 323/320 |
| 5,898,733 | A | 4/1999 | Satyanarayana | 375/133 |
| 5,909,087 | A | 6/1999 | Bryde et al. | 315/149 |
| 5,962,992 | A | 10/1999 | Huang et al. | 315/312 |
| 5,987,205 | A | 11/1999 | Moseley et al. | 385/125 |
| 5,990,635 | A | 11/1999 | Ference et al. | 315/362 |
| 6,037,721 | A | 3/2000 | Lansing et al. | 315/295 |
| 6,046,550 | A | 4/2000 | Ference et al. | 315/291 |

* cited by examiner

| Fig.12A | Fig.12B | Fig.12C | Fig.12D |
|---|---|---|---|

MULTI-SCENE PRESET LIGHTING CONTROLLER

This is a continuation of application Ser. No. 09/220,632 filed on Dec. 24, 1998 now U.S. Pat. No. 6,380,696.

FIELD OF THE INVENTION

The present invention relates generally to lighting controllers and in particular to light dimming systems.

BACKGROUND OF THE INVENTION

Wall-mounted light switches which include a dimmer, known as dimmer switches, have become increasingly popular, especially for applications where it is desirable to precisely control the light intensity in a particular room. Such dimmer switches usually employ a variable resistor which is manipulated by hand to control the switching of a triac which in turn varies the voltage to the lamp to be dimmed.

This type of dimmer switch is simple and easy to construct, but offers limited flexibility. One feature this type of dimmer switch lacks is the ability to return to a preselected light intensity level after having been adjusted to a different light intensity. This type of dimmer switch has no memory to enable it to do this and preselected light intensity levels can be reestablished only by trial and error in manipulating the variable resistor.

There exist touch actuator controls which address some of the limitations of the manually-operated variable resistor controlled dimmer switches just described. One such touch actuator control cycles repetitively through a range of intensities from dim to bright in response to extended touch inputs. A memory function is provided such that, when the touch input is removed, the cycle will be stopped and the level of light intensity at that point in the cycle will be stored in a memory. A subsequent short touch input will turn the light off, and a further short touch input will turn the light on at the intensity level stored in the memory. While this type of switch is an improvement over manually-operated variable resistor controlled dimmer switches, it requires the user to go through the cycle of intensity levels in order to arrive at a desired intensity level. In addition, it still lacks the ability to return to a desired intensity level after having been adjusted to a different light intensity. A user must go through the cycle again until he or she finds the light intensity level desired. Moreover, this type of switch has no ability to perform certain aesthetic effects such as a gradual fade from one light intensity level to another.

U.S. Pat. No. 4,649,323 discloses a microcomputer-controlled light control which provides a fade function. The control disclosed in that patent is operated by a pair of switches which provide inputs to a microcomputer. The microcomputer is programmed to determine whether the switches are tapped or held (i.e., whether they are operated for a transitory duration or for a longer period of time). When a switch is held, the light intensity is either decreased or increased, depending on the switch operated, and release of the switch causes the intensity setting to be entered into a memory. If the control is operating at a static light intensity level, a tap of a switch will cause the light intensity level to fade toward a predetermined level, either off, full on or a preset level. A tap while the light intensity level is fading will cause the fade to be terminated and cause the light intensity level to shift immediately and abruptly to either full on or full off, depending on which switch was tapped. This type of control, however, is not without drawbacks. For example, a single tap of a switch by a user is interpreted in either of two very different ways (initiate fade or terminate fade), depending on the state of the control at the time the user applies the tap to a switch. This can be confusing to a user, who may erroneously terminate a fade when it is desired to initiate a fade, and vice versa. In addition, it is not possible to reverse a fade by a subsequent tap of the same switch while a fade is in progress. Instead, a tap while the control is fading in one direction will not reverse the direction of the fade but will cause the control to "jump" to either full on or full off. An abrupt shift from a low intensity level to full on, or from a high intensity to no light at all (full off) can be quite startling to the user and others in the area (and even dangerous, if the user and others are suddenly plunged into darkness).

Commonly assigned U.S. Pat. Nos. 4,575,660; 4,924,151; 5,191,265; 5,248,919; 5,430,356 and 5,463,286 disclose various lighting control systems in which lamps or groups of lamps, in one or more zones, are varied in intensity to produce several different scenes of illumination. The level of intensity of the lamps constituting each lighting group is displayed to the user by either the number of light emitting diodes, LED's illuminated in a linear array of the LED's, or the position of a potentiometer slider in a linear track.

U.S. Pat. Nos. 5,191,265 and 5,463,286 disclose wall mounted programmable modular control systems for controlling groups of lights in one or more zones. In these systems, the lights are controlled by a master control wall module, a remote wall unit, and by a remote hand held control unit. The hand held unit communicates to the master control module by conventional infra-red (IR) transmission techniques.

The lighting control device disclosed in the U.S. Pat. No. 5,248,919 has all of the light control features needed to effectively and safely control the state and intensity level of one or more lights. However, this device lacks many desirable features such as wireless remote controllability, programmability, the ability to lock and unlock a preset, a delayed off, and the ability to store multiple presets. In many cases, it is desirable for a user to be able to have one or more lamps fade to a pre-selected intensity level or state, or to fade to off after a variable delay time. The lighting controls disclosed in the U.S. Pat. No. 5,248,919 are programmed to fade on to the last light level the dimmer was adjusted to prior to being turned off. This presents a problem because every time the light level of the dimmer is adjusted, the preset light level is changed. The user does not have the ability to lock in a light level that can be recalled when the unit is turned on after previously being turned off. It would be useful and desirable to be able to remotely control and program the preset light intensities of one or more lamps associated with one or more lighting scenes.

U.S. patent application Ser. No. 08/614,712 (now U.S. Pat. No. 5,909,087, which is assigned to the assignee of the present invention, and which is incorporated herein by reference, discloses a wallbox dimmer that can be programmed to store multiple preset levels. The infrared-handheld transmitter is manipulated to send infrared signals to the dimmer/receiver to enter a special programming mode. Once in programming mode, the user actuates a scene selector on the transmitter and then adjusts the light level by actuating a raise or a lower actuator on the dimmer/receiver or on the transmitter. The scene level is stored in the dimmer only when another scene select actuator is actuated or programming mode is exited. There is no way to store scene levels in the dimmer without using the transmitter and further there is no way to copy a scene preset from one actuator to another.

U.S. patent application Ser. No. 08/614,712 (now U.S. Pat. No. 5,909,087) further discloses the ability to lock and unlock a single preset light level into memory. With a preset light level locked into memory, when the dimmer is turned on, the dimmer goes to the light level locked in to the memory, and not to the last light level the dimmer was adjusted to prior to being turned off. The method for locking a preset light level into memory involves adjusting the dimmer to a desired light level using an intensity selector and then actuating a separate actuator three times in a short period of time (½ second) to lock the level as a preset. Only one preset can be locked into memory. The patent application (now U.S. Pat. No. 5,909,087) further discloses a method for unlocking the preset. To unlock the preset, the user actuates the separate actuator four times in a short period of time (½ second). When the preset is unlocked, the dimmer works like the dimmer disclosed in the U.S. Pat. No. 5,248,919, when it is turned off and then back on again.

Another lighting control device known in the art as "Onset Dimmer OS600" is manufactured by Lightolier Controls, Inc. The Lightolier device uses a separate dedicated switch in order to lock in a single preset light intensity level.

U.S. Pat No. 5,821,704, assigned to The Genlyte Group Incorporated, discloses a lighting control and dimming system that utilizes a single line voltage conductor for transmitting analog signals corresponding to a particular light intensity level of dimmers DIM 1, DIM 2, . . . DIM N in a dimmer group. Remote signaling and selection of a specific scene are performed independently of the phase of the applied AC line voltage by sampling the logic values of logic high to logic low and logic low to logic high transitions of a zero cross signal. Dimmers enabled by the transmitted analog signal produce a predetermined scene at a particular brightness level corresponding with one of the stored binary numbers.

The MULTISET family of dimmers and master control is available from Lightolier Controls Inc., a subsidiary of the assignee of the '704 patent. The system consists of wallbox dimmers and a master control. The wallbox dimmers are each connected directly to a load. The user can access up to four presets plus "full on" and "off" from the master control. The master control is capable sending preset signals over a single line voltage conductor to a maximum of 30 devices. To store a preset value in each dimmer, the user actuates a scene preset button on the master control, which causes all dimmers to go to their preset light level for that scene, and then adjusts the light intensity of the connected load at each of the dimmers, and then presses a very small dedicated "store" actuator on each dimmer. The process of storing preset values is time consuming and requires a pin or other small device in order to access the store button. The only function of the store button is to store a light level as a preset, the store button can not be used to recall a preset. The master control is not capable of directly controlling an attached load.

The SCENE SELECT lighting control is available from Leviton Manufacturing Co. Inc. and is made up of Scene Dimmers and Scene Masters. The Scene Dimmer is a four scenes and off wallbox dimmer that can be connected directly to a load. Each of the four scenes is programmable by the user. The loads can be lighting loads or fan loads. A Scene Dimmer can be used independently to control an associated load or as part of a system with a Scene Master control.

In order to save a level as a preset with the Scene Select lighting control, the faceplate for the lighting control must first be removed. Hence it is impossible for the user to change a preset or scene value after the lighting control is installed without taking the faceplate off. Scenes and presets are herein used interchangeably. To program a scene, the user must press and hold the scene actuator to be programmed, press and hold a "cycle" actuator until the desired light intensity is reached, release the "cycle" button, and then release the scene actuator. When the "cycle" actuator is held the light output from the dimmer continuously cycles up and down until the actuator is released as described above. With only one button to cause the light level to increase or decrease, this makes it very difficult to make small adjustments to the light intensity. If the user just misses the light level needed, the user must go through the entire cycle and hope to catch it the next time through. The preset light levels are stored in the individual dimmers and not in the master control.

The Scene Master is used to signal Scene Dimmers to fade to their respective scenes. The Scene Master communicates to the Scene Dimmers over a single line voltage conductor. The programming of a scene in a system is the same as with an individual dimmer, but it must be done independently for each dimmer in the system. This can be a very time consuming process when there are multiple dimmers. The Scene Master is not used during the storing process.

Another product available from Leviton Manufacturing Co. Inc. is a four preset wall box dimmer that is not user adjustable. The four presets are set at the factory and cannot be changed by the user.

In one prior art system, a user can add a so-called three-way switch, i.e., an additional light control switch, to an existing hard wired single control system by replacing an existing manually operated lighting control device with a lighting control device having a radio frequency receiver incorporated therein. The replacement lighting control device is hard wired into the electrical system in the same way as the conventional device to control a lamp in a lighting fixture. The radio frequency receiver is responsive to radio frequency signals generated by a remote battery powered switching device having a transmitter which can be conveniently affixed to a building wall at another location, thereby to provide the three-way switch circuit. The additional battery powered lighting control device has a manually operated lever, which when operated, sends an RF signal to the other electrical control device which is hard wired into the building's electrical system. The hard wired device will then toggle in response from its present state to the opposite state, i.e., from on to off or off to on. Thus, either switching device, the hard wired replacement or the battery powered device, can operate the lamp. Accordingly, a three-way switch can be provided to an existing electrical system without hard wiring the three-way switch into the system. In this prior art system, having the battery powered transmitting switch and the hard wired switch including the receiver, the hard wired receiving switch includes a whip antenna made from a piece of insulated wire which may be allowed to dangle out of the electrical box either outside the building wall or inside the wall. The receiver in the hard wired switch allows only one way communication i.e., it receives signals from the battery powered transmitting switch. Two-way communication between the hard wired switch and the transmitting switch is not provided. A system of this type is sold by Heath Zenith as the Reflex switch. Another device of this type, which instead employs a hand-held remote control to provide a three way switching function, is manufactured by Dimango.

In another prior art system an existing hard wired manually operated lighting control device is replaced with a lighting control device having a radio frequency receiver incorporated therein. The replacement lighting control device is hard wired into the electrical system in the same way as the conventional device to control the lamp in a lighting fixture. The radio frequency receiver is responsive to radio frequency signals generated by a remote battery powered control device having a transmitter which can be conveniently affixed to a building wall at another location. The battery powered control device has switches to enable the selection of four different light levels. The switches when operated cause an RF signal to be sent to the electrical control device which is hard wired into the building's electrical system. The hard wired device responds to the RF signals by adjusting its output to cause the lamp to operate at one of four different predetermined light levels. In addition to responding to RF signals, the hard wired device can also operate in response to the actuation of manually actuated switches incorporated within it. Two way communication between the hard wired device and the battery powered control device is not provided. A system of this type is sold by Leviton as the Anywhere switch.

Thus there is a need for an improved lighting control and dimming device which offers advantages not possible with prior controls while avoiding the drawbacks of the prior controls. The present invention fills that need.

BRIEF SUMMARY OF THE INVENTION

This invention relates to a lighting control system capable of storing and recalling multiple preset light levels. The method for storing the presets is simple and straight forward. To save a preset light level, the user simply adjusts a dimmer, using a user adjustable intensity selector, to the desired light level and then presses and holds a preset actuator for a non transitory period of time, preferably greater than 1 second, more preferably greater than 3 seconds. To recall the preset light level the user simply actuates the preset actuator, preferably for a transitory period of time, preferably less than 1 second, more preferably less than ½ second. The preset actuator can be mounted in a common housing with the user adjustable intensity selector or a separate housing. When the user adjustable intensity selector and the preset actuator are mounted in a common housing, preferably the user adjustable intensity selector is spaced from the preset actuator by no less than 1".

The present invention also relates to a lighting control system capable of communicating from a master control to a dimmer without the need for additional wiring. The master communicates with the dimmer preferably through infrared energy within the wallbox. An infrared transmitting diode located within the master control directs the infrared energy out of the master for receipt by the dimmers.

The present invention also relates to a lighting control system capable of communicating from a master control located in a first wallbox to a dimmer located in a second wallbox. The master communicates to the dimmer preferably through signals transmitted through a flexible conductor. In a first preferred embodiment, the signals are infrared signals conducted through an infrared conductive cable such as a hollow flexible tube or a fiber optic cable. In a second preferred embodiment an infrared transmitting diode is located at an end of an electric cable, the other end being connected to the master control. The cable can be easily routed from the first wallbox to the second wallbox.

BRIEF DESCRIPTION OF THE DRAWINGS

For the purposes of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1A:
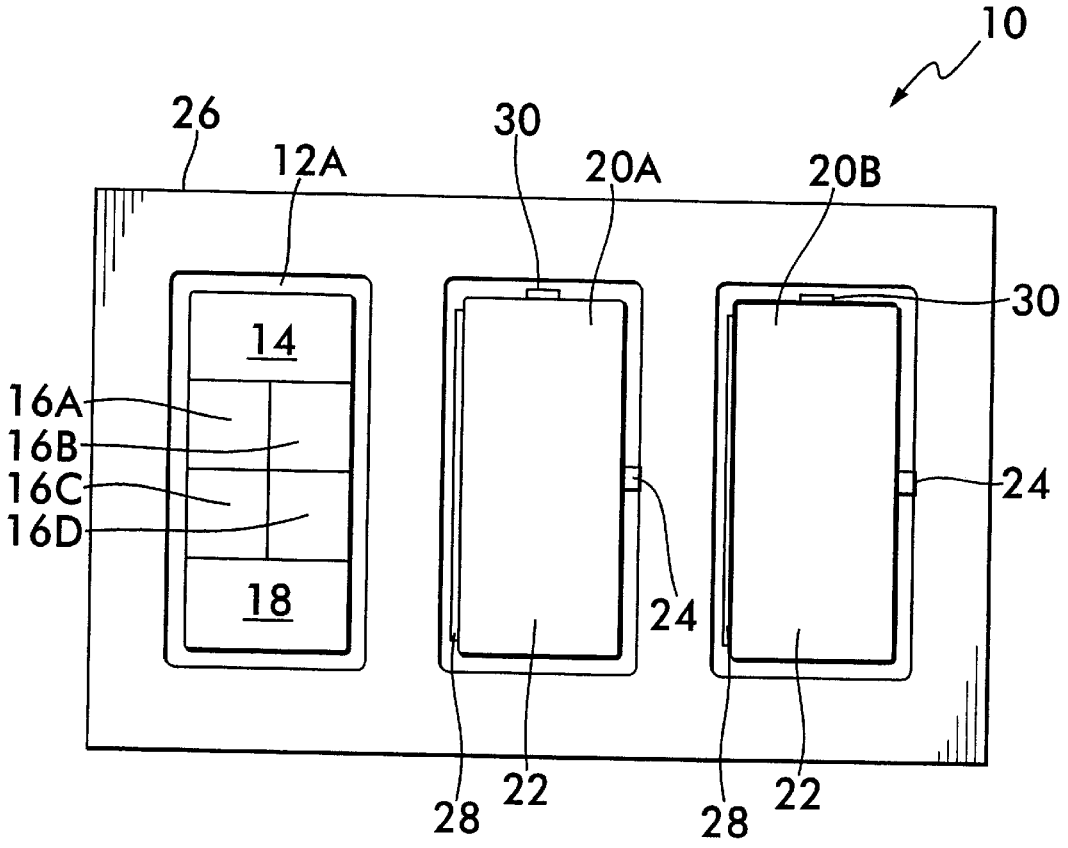
FIG. 1A PRIOR ART
FIG. 1A shows a lighting control system of the prior art.
Figure 1B:
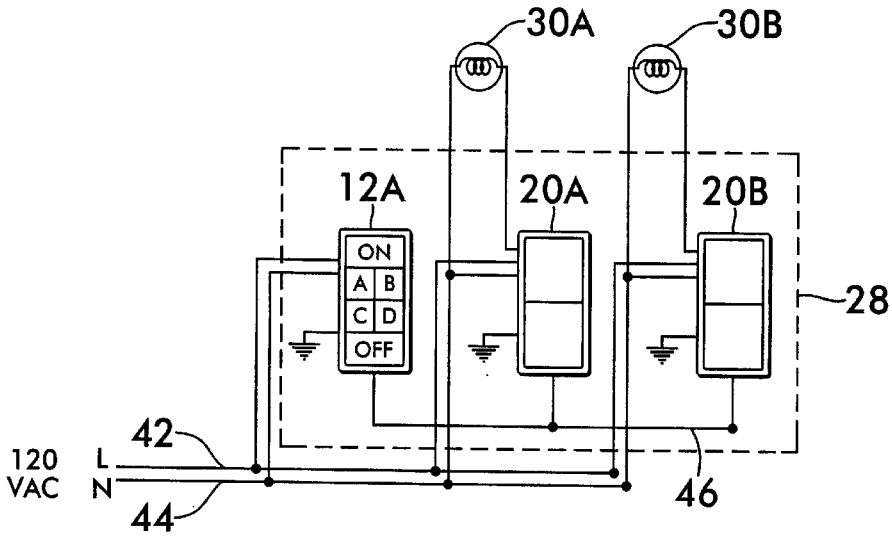
FIG.1B PRIOR ART
FIG. 1B shows the proper wiring between the components of the lighting control system of FIG. 1A when all of the components are mounted in the same wallbox.
Figure 1C:
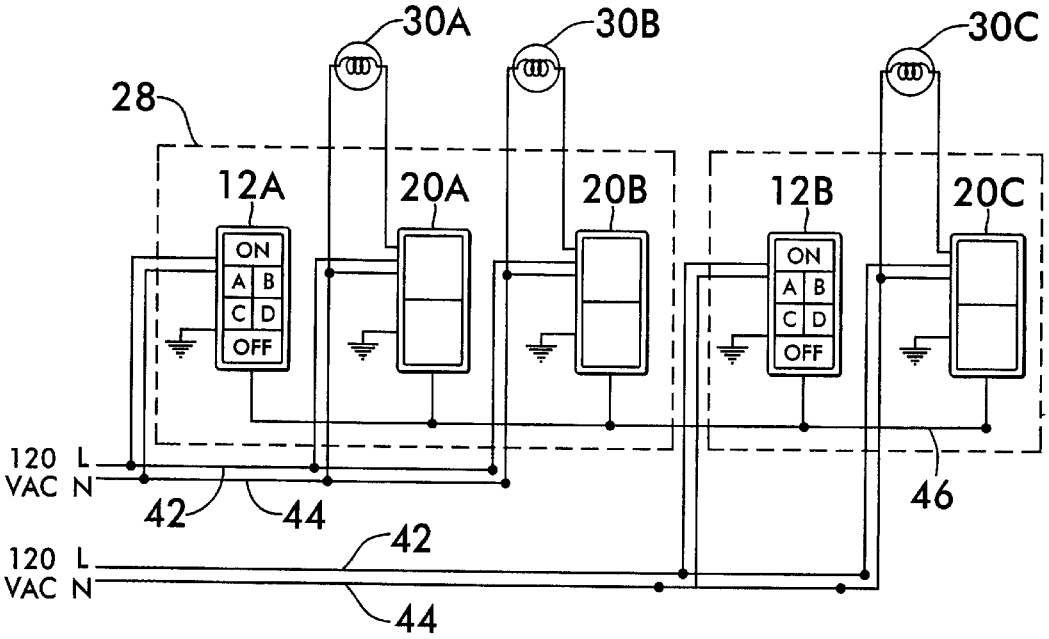
FIG.1C PRIOR ART
FIG. 1C shows the proper wiring between the components of the lighting control system of FIG. 1A when some of the components are mounted in a separate wallbox.

Referring to the drawings, wherein like numerals indicate like elements, there is shown in FIGS. 1A, 1B and 1C a lighting control system of the prior art. The system 10 consists of a master control 12A and a pair of dimmers 20A and 20B secured behind a common faceplate 26. This system is available from Lightolier Controls Inc., and is sold under the name Multiset. The master control 12A has six actuators 14, 16A, 16B, 16C, 16D, and 18. The actuation of any of these actuators for a transitory period of time causes the master control to signal the dimmers 20A and 20B to fade to a light level that is stored in each of the dimmers 20A and 20B. The master control is incapable of controlling a load directly. Actuators 16A, 16B, 16C, 16D access preset light levels that are user adjustable. The actuation of either actuators 14 or 18 for more than a transitory period of time causes the master control to signal the dimmer 20A and 20B to raise or lower their present light level. Actuator 14 raises the light level and actuator 18 lowers the light level. This is often referred to as a master raise/lower function. The actuation of actuator 14 for a transitory period of time causes the master control to signal the dimmers 20A and 20B to fade to full light output. The actuation of actuator 18 for a transitory period of time causes the master control to signal the dimmers 20A and 20B to fade to off. The master control 12A signals the dimmers 20A and 20B by sending information over a single line voltage conductor 46 (shown in FIG. 1B).

Dimmers 20A and 20B control load 30A and 30B (shown in FIG. 1B) respectively. Actuation of actuator 22 above the mid line of the actuator 22 for a transitory period of time causes the dimmer to fade on to a light level stored in memory as a preset. Actuation of actuator 22 below the mid line of the actuator 22 for a transitory period of time causes the dimmer to fade to off. The dimmers 20A and 20B can each be programmed with either a 3 second or 15 second fade time. The light level of the connected loads 30A and 30B are shown with indicators 28. An LED 30 serves as a night light. Actuation of actuator 22 for more than a transitory period of time causes the light level of the connected load 30A or 30B to increase if actuated above the midline of the actuator 22 and decrease if actuated below the midline of the actuator 22. Behind actuator 22 are two non latching switches (not shown) which work independently to send input signals to a microprocessor (not shown) for processing. Neither the master 12A nor the dimmers 20A and 20B can receive signals from an infrared transmitter.

The dimmers 20A and 20B can work individually or in a system with a master control 12A to control attached loads 30A and 30B, respectively. When dimmer 20A or 20B is working independently, only a single preset light level can be recalled, as mentioned above, this is the light level the dimmer fades on to when actuator 22 is actuated above the midline of the actuator 22 for a transitory period of time. A very small "set" actuator 24 is located just to the right of actuator 22 to enable the storing of a preset. To store a preset, the user raises or lowers the light level by actuating actuator 22 and then actuates the "set" actuator 24. The only function of "Set" actuator 24 is for storing a preset light level, it can not be used to recall a light level. Reactuating actuator 24 after a preset light level is stored simply saves the new light level in to the preset.

When the dimmer 20A and 20B work in a system 10, they have the ability to store multiple presets. These presets can be accessed by actuating actuators 16A, 16B, 16C, or 16D on the master control 12A. When the user actuates actuator 16A, all the dimmers connected to the master with single line voltage conductor 46 go to their respective first preset and likewise for the other three preset actuators. To store a preset for recall from the master control 12A, the user must select a preset to be stored by actuating one of the actuators 16A, 16B, 16C, or 16D on the master control, raise or lower the light level on each of the dimmers 20A and 20B by actuating actuator 22, and then actuates the "set" actuator 24 on each of the dimmers 20A and 20B. This can be a very time consuming process as more and more dimmers get added to the system 10. With this type of system 10, the user can not copy a preset without going through the entire process.

FIG. 1B shows how the dimmers 20A and 20B and the master 12A are connected to a power source (120 VAC). The dimmers 20A and 20B and the master control 12A are located in a common wallbox 28. The master 12A connects directly to hot conductor 42 and neutral conductor 44. One lead of each dimmer 20A and 20B connects to hot conductor 42 and another lead connects to the load 30A and 30B respectively. A third lead of each dimmer 20A and 20B is connected to a neutral conductor 44. The other side of each of the loads 30A and 30B is connected to neutral conductor 44. The master communicates to the dimmers over a single line voltage conductor 46.

FIG. 1C shows how a master control 12A in a first wallbox 28 communicates with a dimmer 20C and master control 12B in a second wallbox 28A at a different location. For the system to work properly, the single line voltage conductor 46 must extend from the first wallbox 28 to the second wallbox 28A.

Figure 2A:
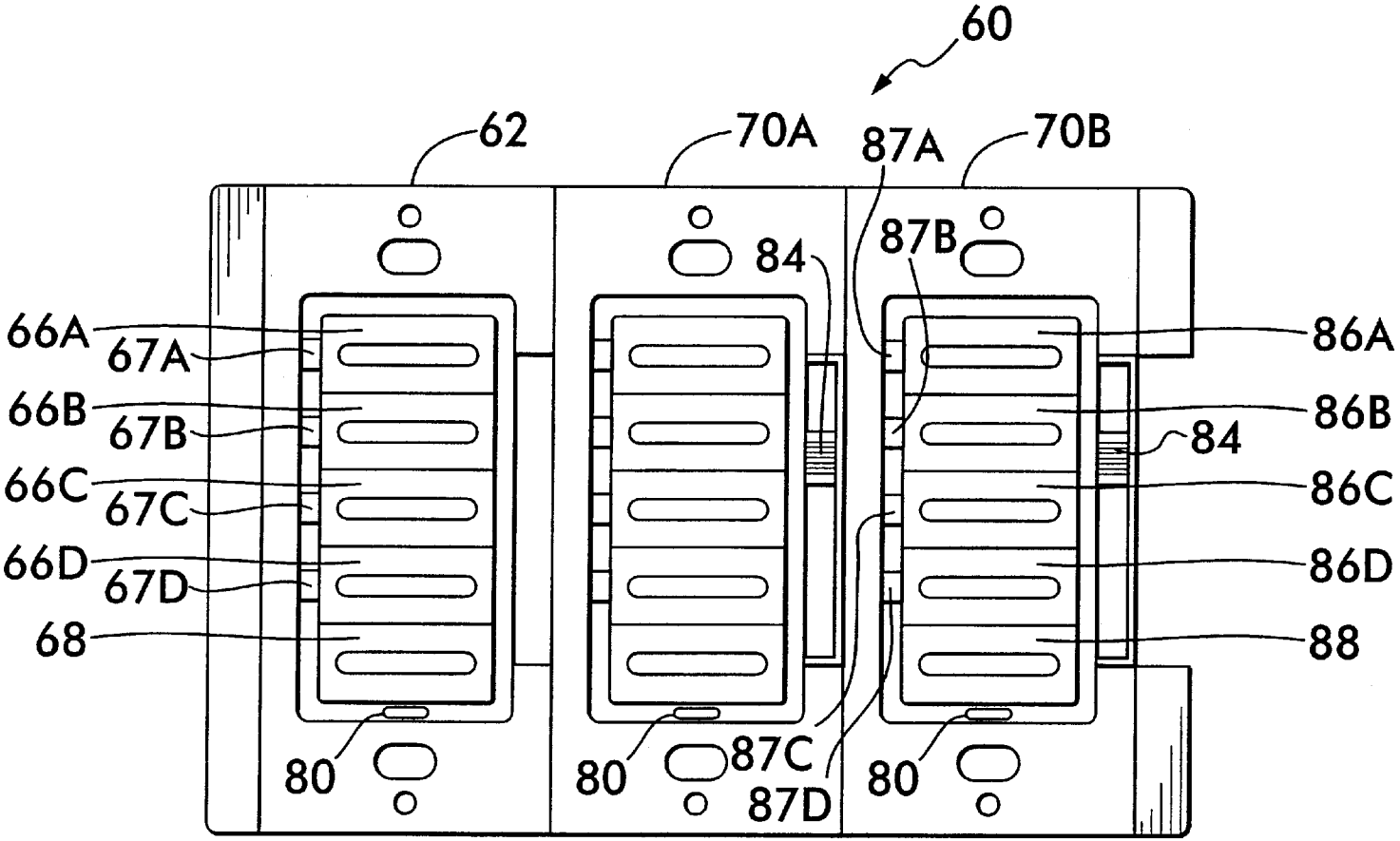
FIG. 2A PRIOR ART
FIG. 2A shows a lighting control system of the prior art.

FIG. 2A shows a lighting control system of the prior art. The system 60 consists of a Scene Master 62 and a pair of Scene Dimmers 70A and 70B secured in a common wallbox and shown without a faceplate for clarity. This system is available from Leviton Manufacturing Co. Inc. and is sold under the name Scene Select. The Scene Master and the Scene Dimmer look almost identical except the dimmer has a "cycle" actuator 84. The Scene Master is incapable of controlling a load directly. The Scene Master 62 has five actuators 66A, 66B, 66C, 66D, and 68 for recalling four "scene" presets and off. The Scene Master communicates to the dimmers 70A and 70B over a single line voltage conductor 96 (shown in FIG. 2B). The Scene Dimmers 70A and 70B can be operated individually or in a system with a Scene Master to control an attached load 80A or 80B respectively. The Scene Master actuators 66A, 66B, 66C and 66D have corresponding indicators 67A, 67B, 67C, and 67D. The Scene Master 62 and the Scene Dimmer 70A and 70B each have a nightlight 80.

Each of the Scene Dimmers 70A and 70B have actuators 86A, 86B, 86C, 86D, and 88 for recalling the "scene" presets and off. When any of these actuators are actuated just the dimmer actuated fades to the preset light level, the other dimmers stay the way they were. These preset light levels are user adjustable. The Scene Dimmer actuators 86A, 86B, 86C and 86D have corresponding indicators 87A, 87B, 87C, and 87D. Scene Dimmers also have a cycle actuator used in the storing of the presets. To store a preset in a dimmer, the user must first press and hold the "scene" actuator to be programmed, and then press and hold the "cycle" actuator 84 until the desired light level is achieved, release the "cycle" actuator when the desired light level is achieved and then release the "scene" actuator. As mentioned above, in a system with a "cycle" actuator, it is very difficult to precisely set the light level. In this system the process of storing a preset is "hold", "adjust", and "let go".

When an actuator 66A, 66B, 66C, 66D, or 68 on the Scene Master is actuated, all the connected dimmers 70A and 70B fade to their respective preset light levels for that scene. This makes it impossible to copy a preset from one actuator to another.

Figure 2B:
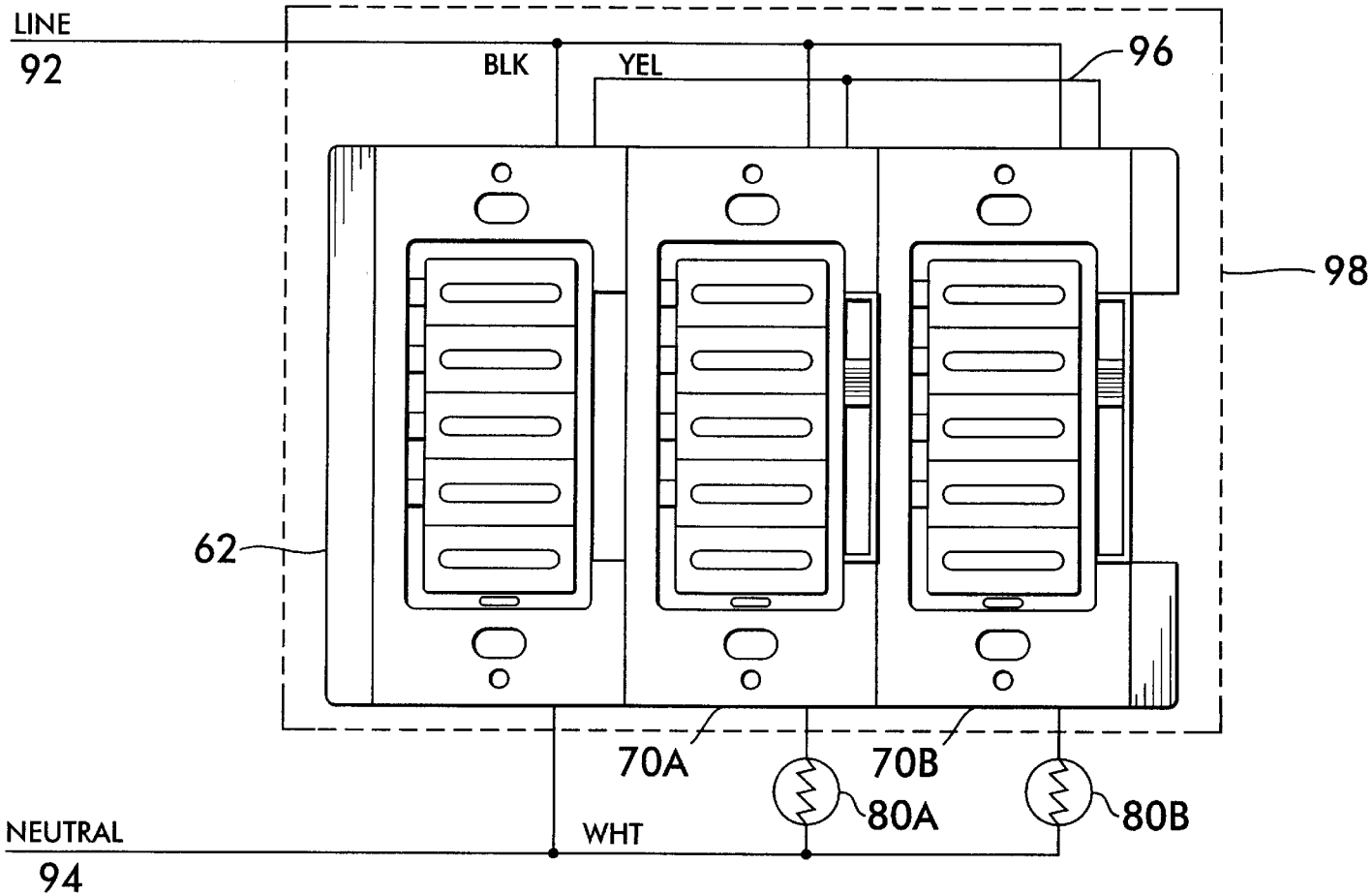
FIG. 2B PRIOR ART
FIG. 2B shows the proper wiring between the components of the lighting control system of FIG. 2A.

FIG. 2B shows how the Scene Master 62 and the Scene Dimmers 70A and 70B are connected to a power source (120 VAC) The Scene Master 62 connects directly to hot conductor 92 and neutral conductor 94. One lead of each dimmer 70A and 70B connects to hot conductor 92 and another lead connects to the loads 80A and 80B respectively. The other side of the load 80A and 80B connects to neutral conductor 94. The master communicates to the dimmer over a line voltage conductor 96. For the Scene Master 62 to communicate with Scene Dimmers in other wallboxes (not shown), the single line voltage conductor 96 needs to be extended to that wallbox.

Figure 3:
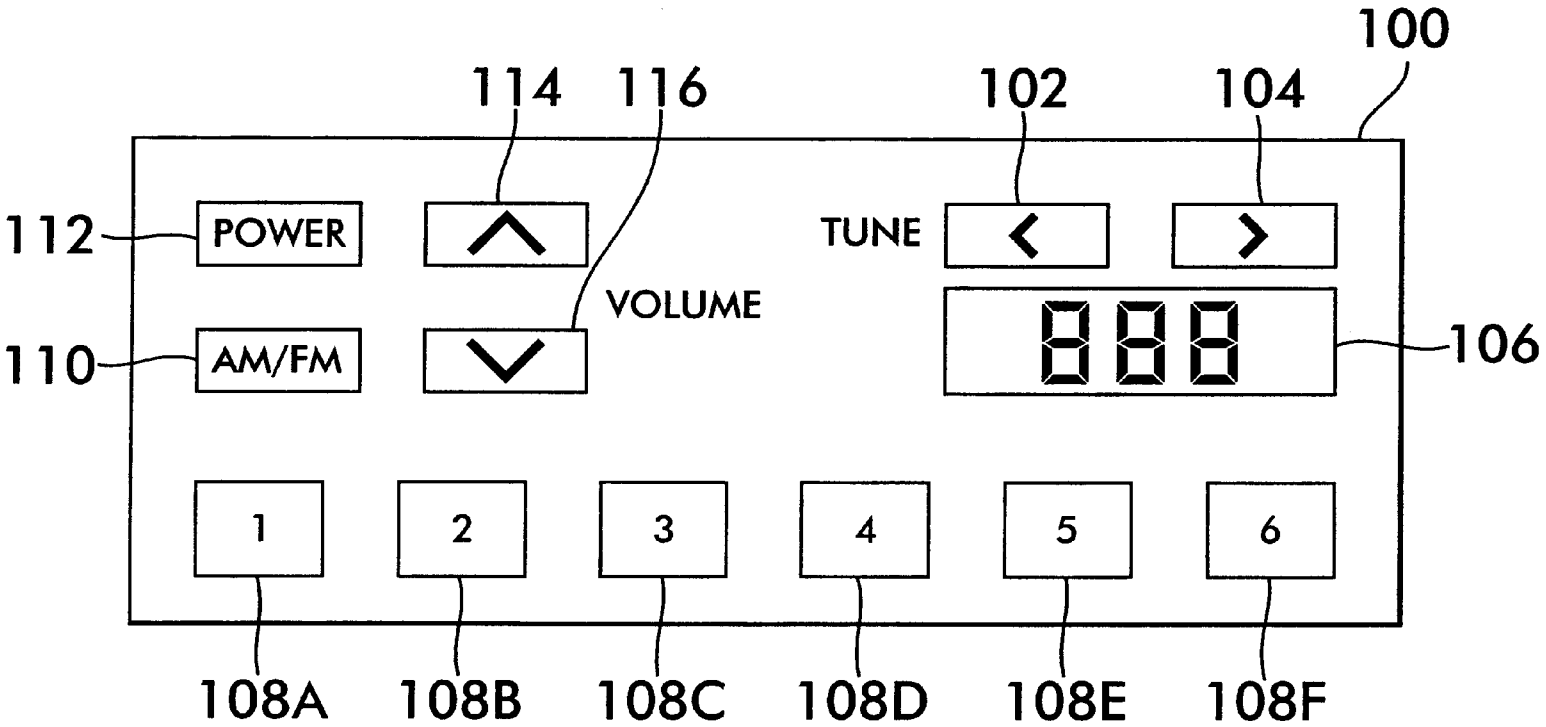
FIG. 3 PRIOR ART
FIG. 3 shows the front view of a car radio typical of the prior art.

FIG. 3 shows the front view of a typical prior art car radio. The radio is capable of storing six preset AM stations and six FM stations. The presets allow the user to quickly and easily recall their favorite radio stations. The car radio 100 is turned on using power actuator 112. The receiving frequency to be played by the car radio 100 is selected using frequency down actuator switch 102 or the frequency up actuator switch 104. The frequency is displayed in display 106. The volume is adjusted using volume increase actuator 114 or volume decrease actuator 116. The car radio 100 can be switched from AM to FM using actuator 110. The six preset actuators 108A, 108B, 108C, 108D, 109E, and 108F are reused to select both the AM presets and the FM presets. The preset recalled is based on the status of actuator 110 and the preset actuator 108A, 108B, 108C, 108D, 109E, or 108F selected. When the user actuates one of the preset actuators 108A, 108B, 108C, 108D, 109E, or 108F for a transitory period of time, the radio goes to the stored frequency. To store a preset frequency, the user selects the desired frequency by actuating actuator 102 or 104, then presses and holds the preset actuator 108A, 108B, 108C, 108D, 109E, or 108F to be programmed for longer than a transitory period of time, usually 2–3 seconds. As soon as the preset actuator 108A, 108B, 108C, 108D, 109E, or 108F is pressed the sound coming out of the speakers goes away. At the end of the 2–3 second time period the sound coming out of the speakers reappears to let the user know that the frequency is now stored. In some car radios, the radio also makes a beep sound to alert the user that the frequency is now stored.

Figure 4:
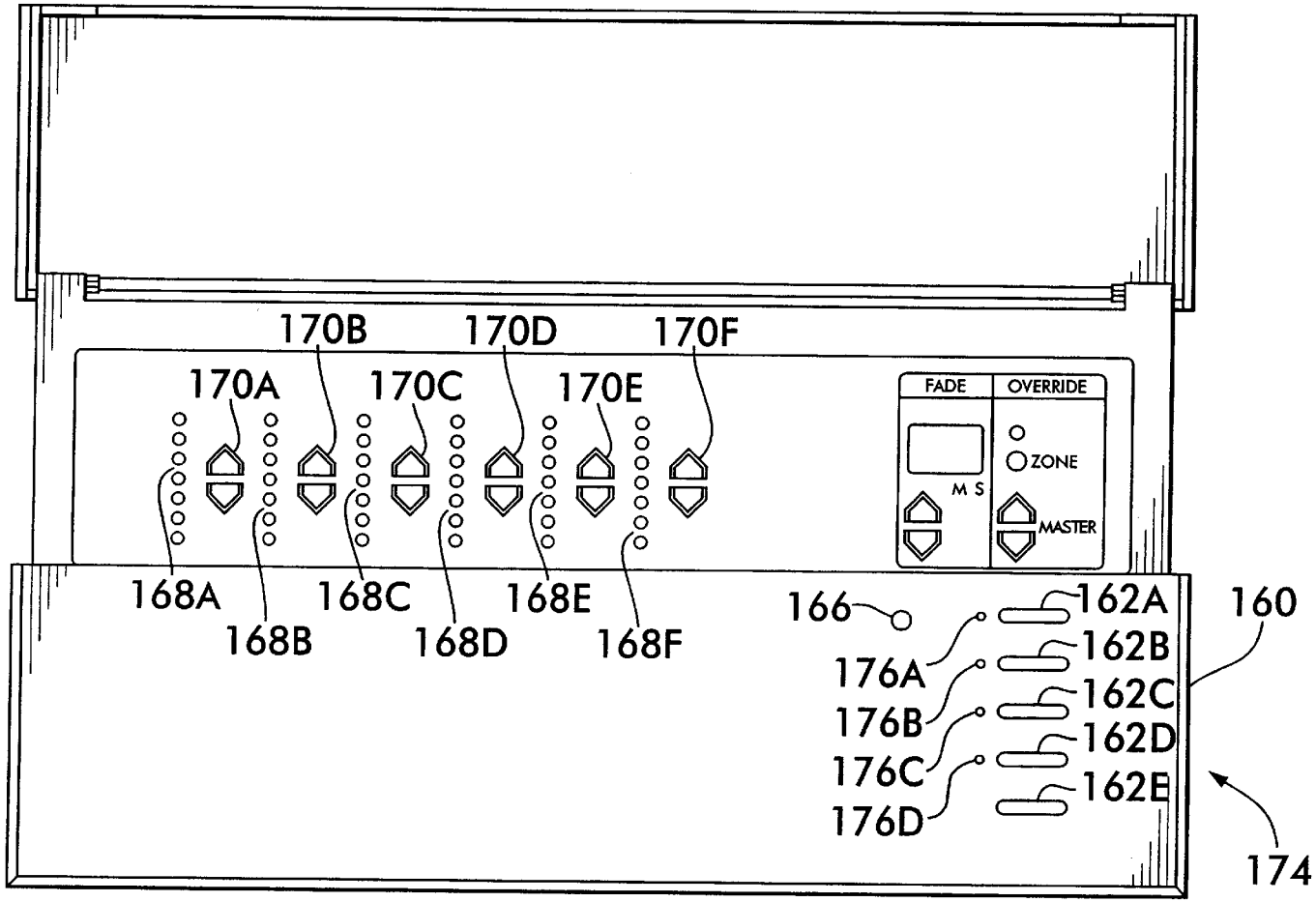
FIG. 4 PRIOR ART
FIG. 4 shows a lighting control which is available from the assignee of the present invention.

FIG. 4 shows a lighting control device known as the Grafik Eye® preset lighting controller which is available from the assignee of the present invention. The lighting control 160 has six dimmers contained in a common housing 174 and has the ability to control six individual lighting channels. The six dimmers are controlled using user adjustable intensity selectors 170A, 170B, 170C, 170D, 170E, and 170F. The light level of each of the six channels is displayed using displays 168A, 168B, 168C, 168D, 168E, and 168F. The lighting control device 160 has the ability to store and recall four preset lighting scenes and an off scene. The four preset scenes are recalled by actuating preset actuators 162A, 162B, 162C, and 162D. Each scene actuator 162A, 162B, 162C, and 162D has a corresponding scene indicator LED 176A, 176B, 176C and 176D. The lighting control device 160 also responds to infrared signals received through an IR preamp 166. To store the light levels for each of the six channels for recall later, the user must first select a preset actuator 162A, 162B, 162C, or 162D, and then adjust each of the user adjustable intensity selectors 170A, 170B, 170C, 170D, 170E, and 170F. The light levels are automatically stored in to memory without the actuation of a "store" or "learn" actuator. When any of the preset actuators 162A, 162B, 162C, or 162D are selected, all of the dimmers instantaneously start to fade to their present preset value. This makes it impossible to copy a scene from one preset actuator to another.

The process of storing preset light levels in the Grafik Eye® preset lighting controller is modified according to the present invention by changing the microprocessor code presently available. The code is modified so that the preset light levels are stored into memory only after a desired light intensity has been selected and a preset actuator is held for a non-transitory period of time.

Figure 5A:
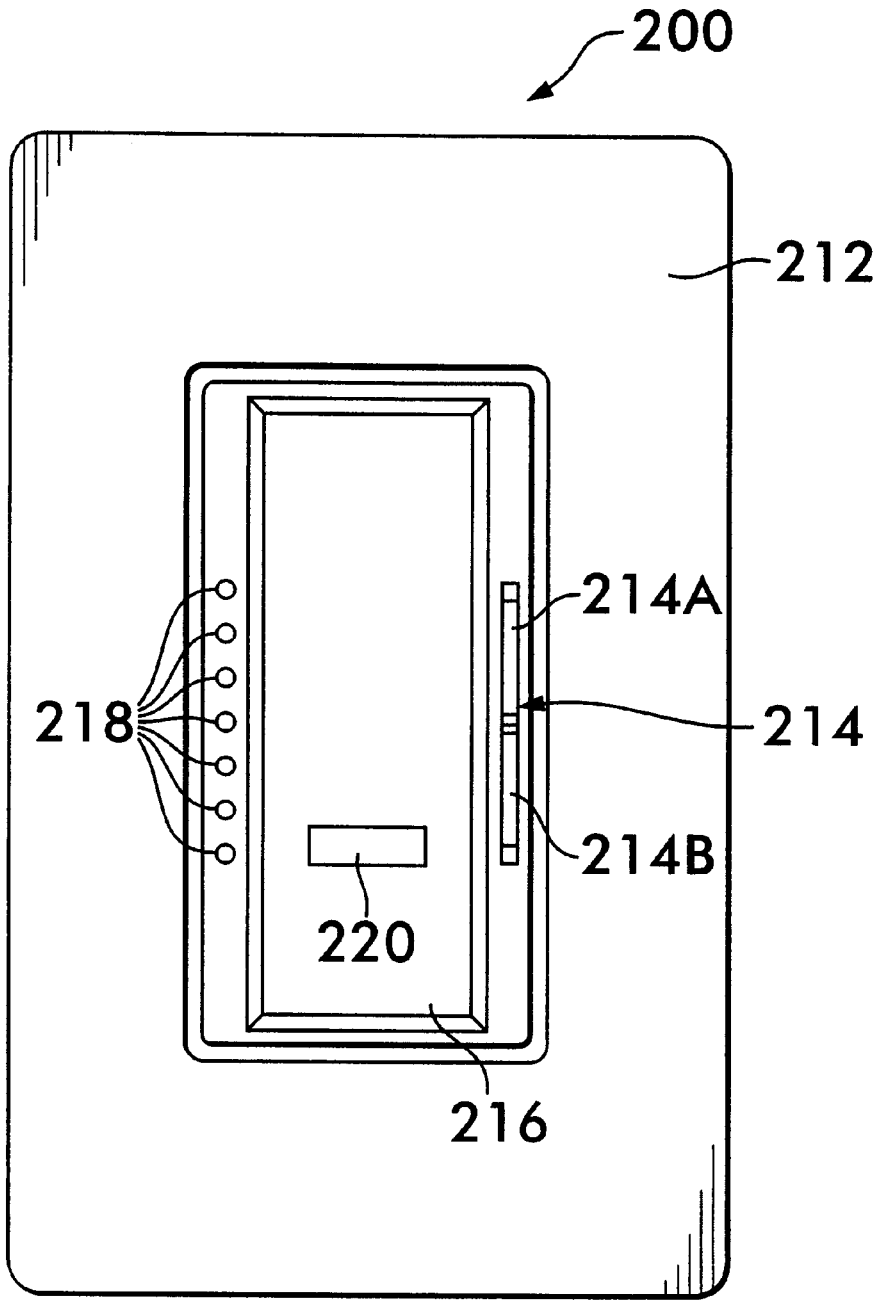
FIG. 5A shows a first embodiment of a wall mountable dimmer of the lighting control system of the present invention.

FIG. 5A shows a dimmer 200 of the present invention with a faceplate 212. The dimmer 200 is similar in construction to the Spacer® dimmer available from the assignee of the present application, but the microprocessor code has been modified. The operation of the Spacer dimmer is disclosed in U.S. patent application Ser. No. 08/614,712 (now U.S. Pat. No. 5,909,087), which is herein incorporated by reference. The dimmer 200 has a large actuator 216 which when actuated signals a microprocessor 828 by closing a single non latching switch 840 (both shown in FIG. 9). Within the border of the large actuator 216 is an infrared receiving window 220 for receiving infrared signals. Located behind the infrared receiving window is a suitable IR preamp 850 (shown in FIG. 9). A user adjustable intensity actuator 214 is used to raise or lower the light level of an attached load. When the user actuates the upper portion of the actuator 214 labeled 214A the light level of the attached load increases. When the user actuates the lower portion of the actuator 214 labeled 214B the light level of the attached load decreases. Non latching switches 842 and 844 (shown in FIG. 9) located appropriately behind actuator 214 provide signals to the microprocessor 828 (shown in FIG. 9) to raise or lower the light level of the attached load respectively. Certain functions of the Spacer Dimmer are disclosed in U.S. Pat. No. 5,248,919, which is herein incorporated by reference. An LED array 218 is used to display information about the light level of the attached load. The LED array is also used to display other information as disclosed in U.S. Pat. No. 5,399,940, which is herein incorporated by reference. The Dimmer 200 has an optically clear backcover, not shown, to enclose the electronics. The optically clear backcovers can be molded from Lexan® resin number 920A, color 21051 available from General Electric. Infrared energy received through the backcover is capable of receipt by the IR preamp 850 (shown in FIG. 9).

Figure 5B:
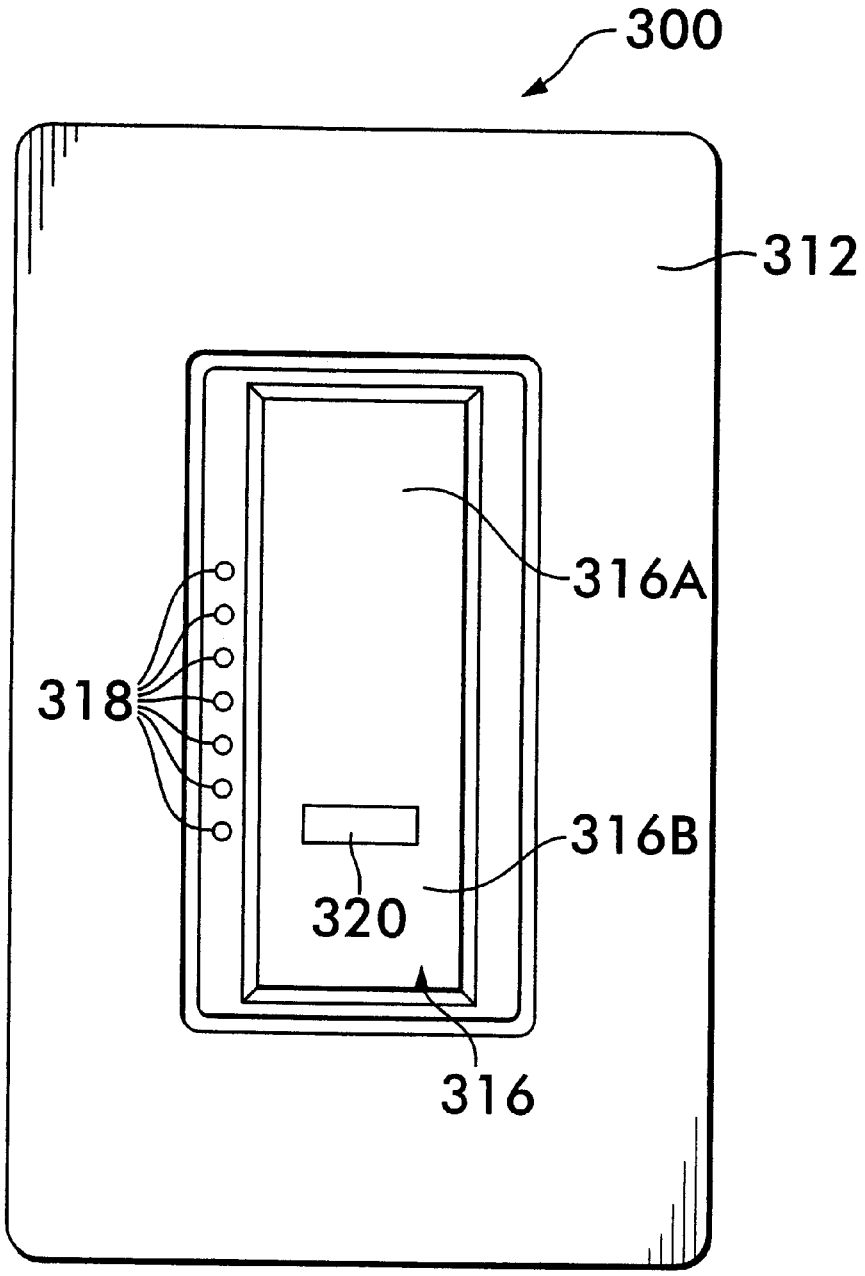
FIG. 5B shows an alternative embodiment of a wall mountable dimmer of lighting control system of the present invention.

FIG. 5B shows a dimmer 300 which can be used to perform many of the same functions as the dimmer 200. The light intensity actuator 214 has been removed. The large actuator 316 when pressed towards the upper portion 316A for longer than a transitory period of time (preferably greater than 1 second, more preferably greater than 3 seconds) raises the light intensity of the connected load and pressing the lower portion 316B for longer than a transitory period of time (preferably greater than 1 second, more preferably greater than 3 seconds) lowers the light intensity of the connected load. Pressing the large actuator 316 towards the upper portion 316A for a transitory period of time (preferably less than 1 second, more preferably less than ½ second) causes the load to fade on to a preset light level. Pressing the large actuator 316 towards the lower portion 316B for a transitory period of time (preferably less than 1 second, more preferably less than ½ second) causes the load to fade to off. The dimmer 300 is shown with a faceplate 312, LED array 318 and infrared (IR) receiving window 320.

Figure 6A:
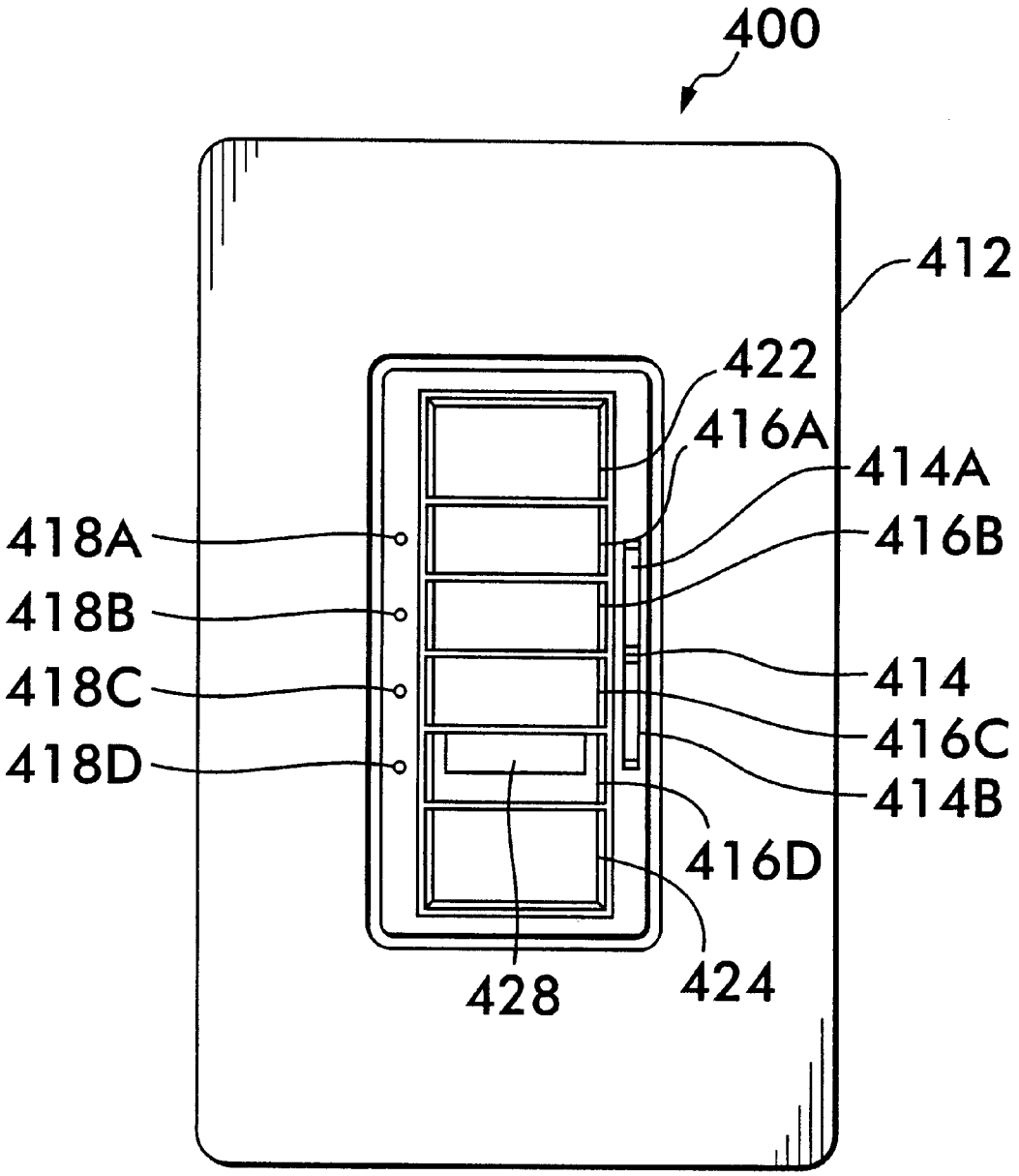
FIG. 6A shows a first embodiment of a wall mountable master control of the system of the present invention.

FIG. 6A shows a master control 400 of the present invention with a faceplate 412. The master control has an "ON" actuator 422, four preset actuators 416A, 416B, 416C, 416D, and an "OFF" actuator 424 that actuate switches 930, 932, 934, 936, 938, and 940 respectively (shown in FIG. 10).

Figure 10:
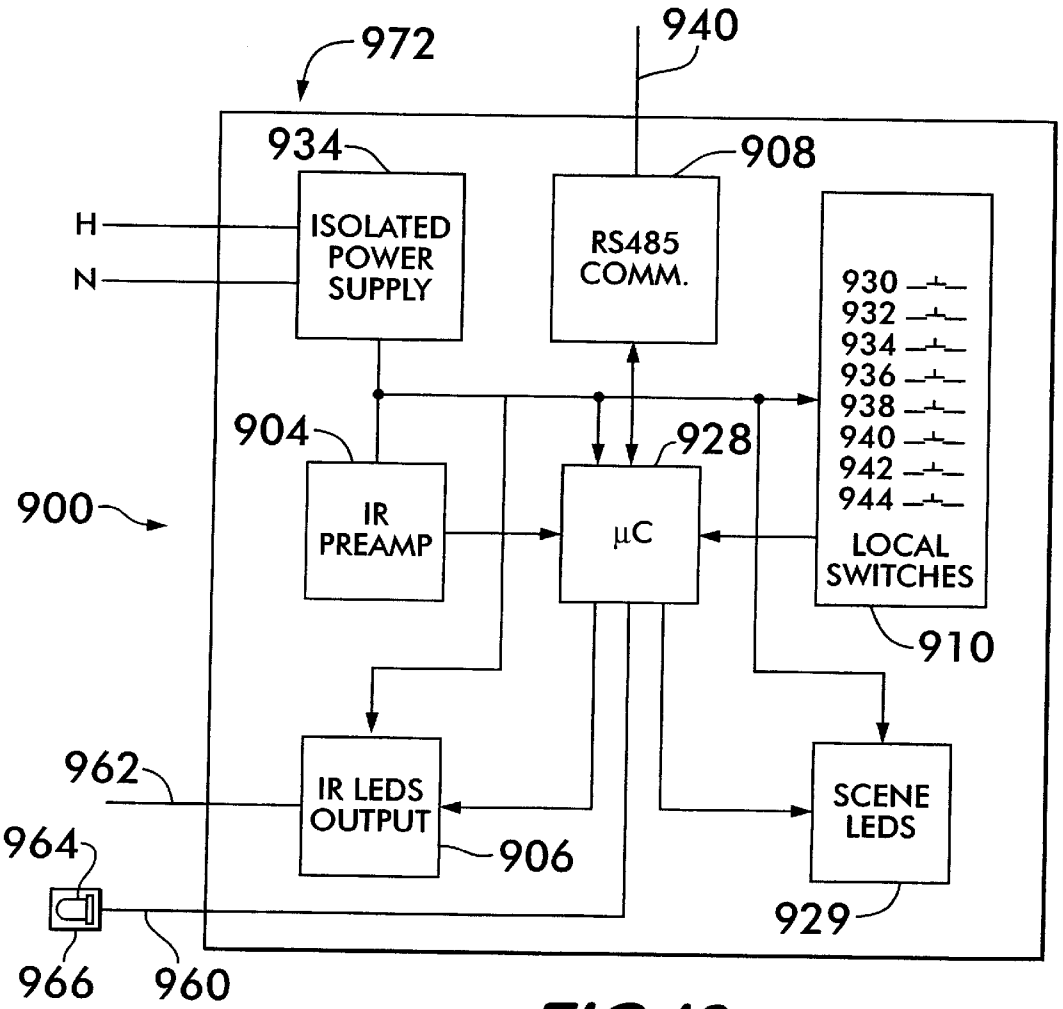
FIG. 10 shows a block diagram of the electrical components of the master control of the system of the present invention of FIGS. 6A or 6B.

The master control has an intensity actuator 414 which has an upper portion 414A and a lower portion 414B which actuate switches 942 and 944 respectively (shown in FIG. 10). Non latching switches 942 and 944 located appropriately behind actuator 414 input signals to the microprocessor 928 (shown in FIG. 10). Actuation of the upper portion 414A closes switch 942 and causes the microprocessor 928 (shown in FIG. 10) to output a master raise signal to signal dimmers and other master controls. Actuation of the lower portion 414B closes switch 944 and causes the microprocessor 928 to output a master lower signal to dimmers and other master controls. Next to each preset actuator is a preset indicator 418A, 418B, 418C, and 418D to signal the user that the master control is active in a particular preset. The indicators can be LEDs, but are not limited to LEDs. The master control 400 further includes an infrared receiving window 428. The IR receiving window 428 receives IR from handheld transmitters 600 and 700. The signals received are used to update LEDs in the master control. The IR receiving window 428 can be deleted if scene status is not required. Spaced behind the infrared receiving window is an IR preamp 904 (shown in FIG. 10). The master control has an optically clear backcover (not shown). The user intensity selector 414 could be replaced with a cycle button or a linear slide potentiometer.

Figure 6B:
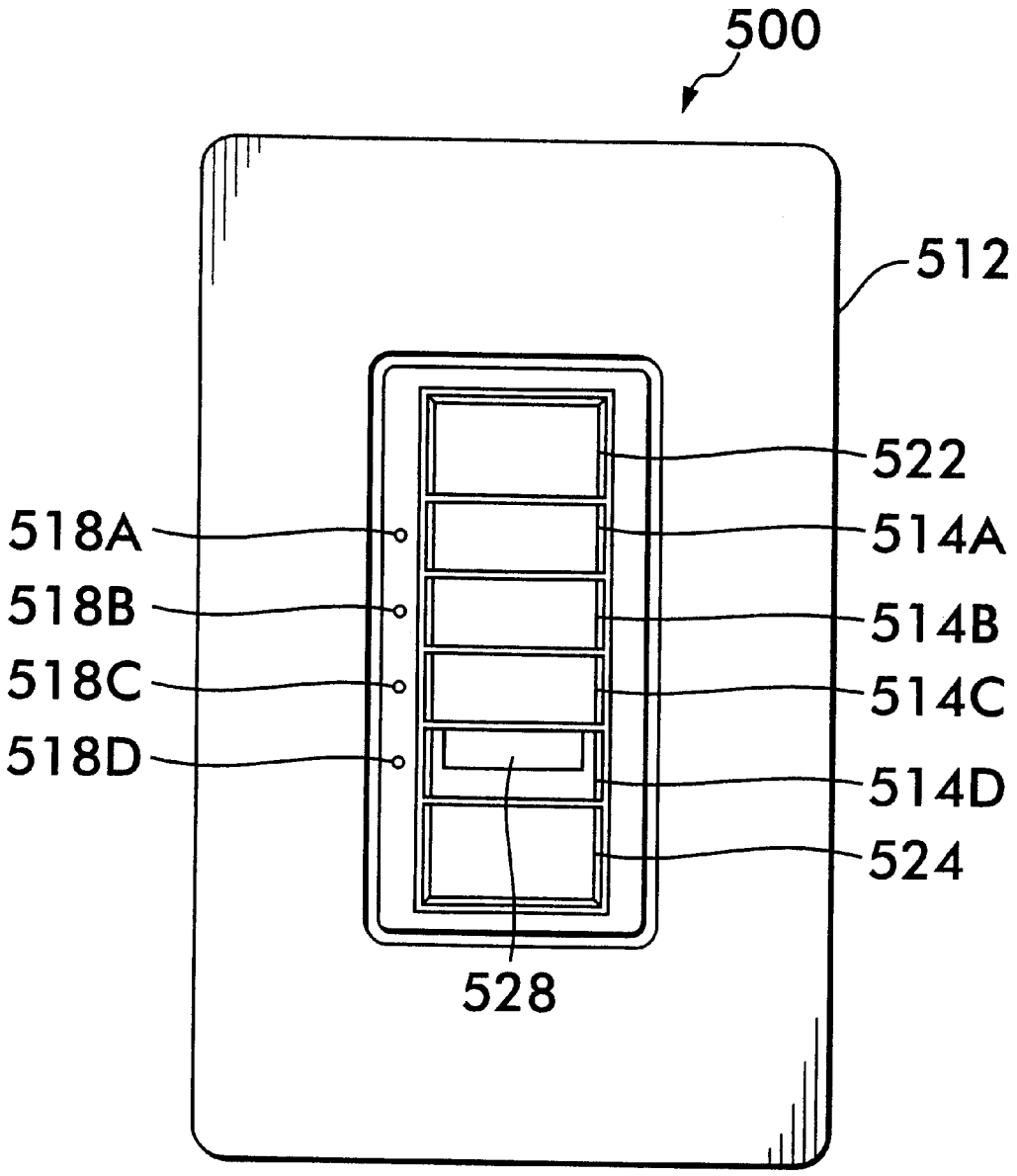
FIG. 6B shows a second embodiment of a wall mountable master control of the system of the present invention.

FIG. 6B shows a master control 500 which can be used to perform many of the same functions of the master control 400. The light intensity actuator 414 has been removed. Actuator 522 when pressed for longer than a transitory period of time causes the microprocessor to send a master raise signal to all dimmers and master controls and pressing actuator 524 for longer than a transitory period of time causes the microprocessor to send a master lower signal to all dimmers and other master controls. Pressing actuator 522 for a transitory period of time causes the load to fade on to full light and pressing actuator 524 for a transitory period of time causes the load to fade to off. Actuators 514A, 514B, 514C, and 514D perform the same function as actuators 416A, 416B, 416C, 416D on master control 400. The master control 500 is shown with a faceplate 512, preset indicators 518A, 518B, 518C, and 518D, and infrared (IR) receiving window 528.

Figure 7A:
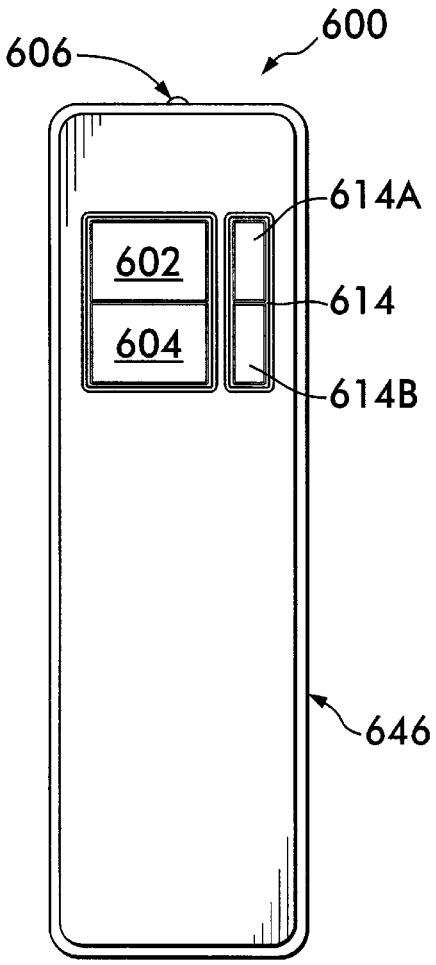
FIG. 7A shows a first embodiment of a hand-held wireless transmitter for use in the system of the present invention.

FIG. 7A shows an infrared transmitter 600 in an enclosure 646. The infrared energy is transmitted through an IR diode 606 extending out an end of the transmitter 600. The transmitter 600 has an "Basic on" actuator 602 and an "off" actuator 604. When the "Basic on" actuator 602 is actuated, the transmitter 600 outputs a "Basic on" preset signal through the IR diode 606. When the "off" actuator is actuated, the transmitter 600 outputs a "off" signal though the IR diode 606. The transmitter 600 has a user adjustable light intensity actuator 614 which is used to raise or lower the light level of an attached load. When the user actuates the upper portion of the actuator 614 labeled 614A the transmitter 600 outputs a raise signal though the IR diode 606. When the user actuates the lower portion of the actuator 614 labeled 614B the transmitter 600 outputs a lower signal though the IR diode 606. Actuator 602 could alternatively send out a "on to preset" or a "scene 1" command.

Figure 7B:
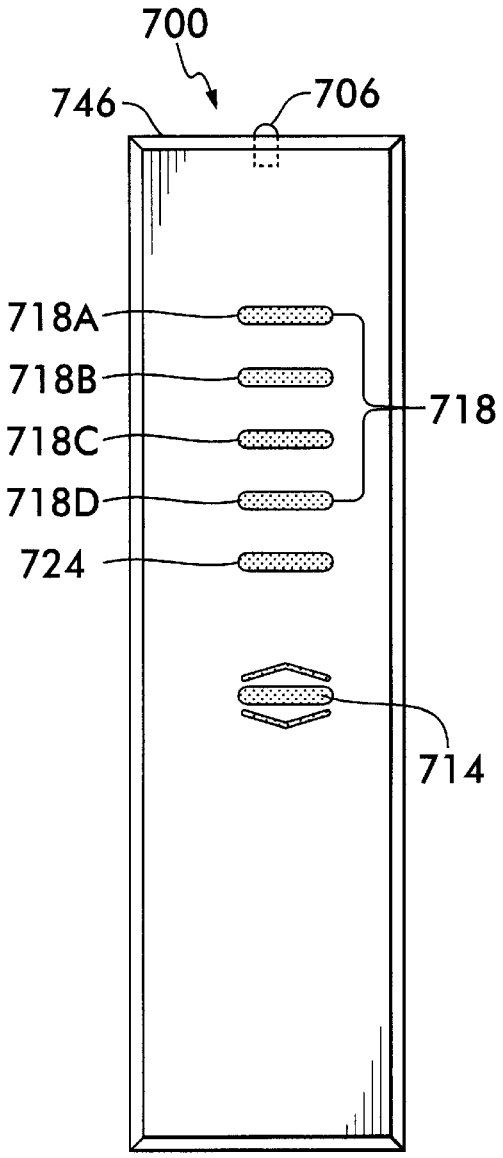
FIG. 7B shows a second embodiment of a hand-held wireless transmitter for use in the system of the present invention.

FIG. 7B shows another infrared transmitter 700 in an enclosure 746. The infrared energy is transmitted through an IR diode 706 extending out an end of the transmitter. The transmitter has four preset actuators 718A, 718B, 718C, 718D, and an off actuator 724. When any of the four preset actuators 718A, 718B, 718C, or 718D are actuated, the appropriate preset IR signal is outputted through IR diode 706. The transmitter also has a has a user adjustable intensity actuator 714 which is used to output a raise or lower IR signal through IR diode 706. When the user moves actuator 714 towards the four preset actuators, the transmitter outputs a raise signal though the IR diode 706. When the user moves actuator 714 away from the four preset actuators, the transmitter outputs a lower signal though the IR diode 706.

Figure 8A:
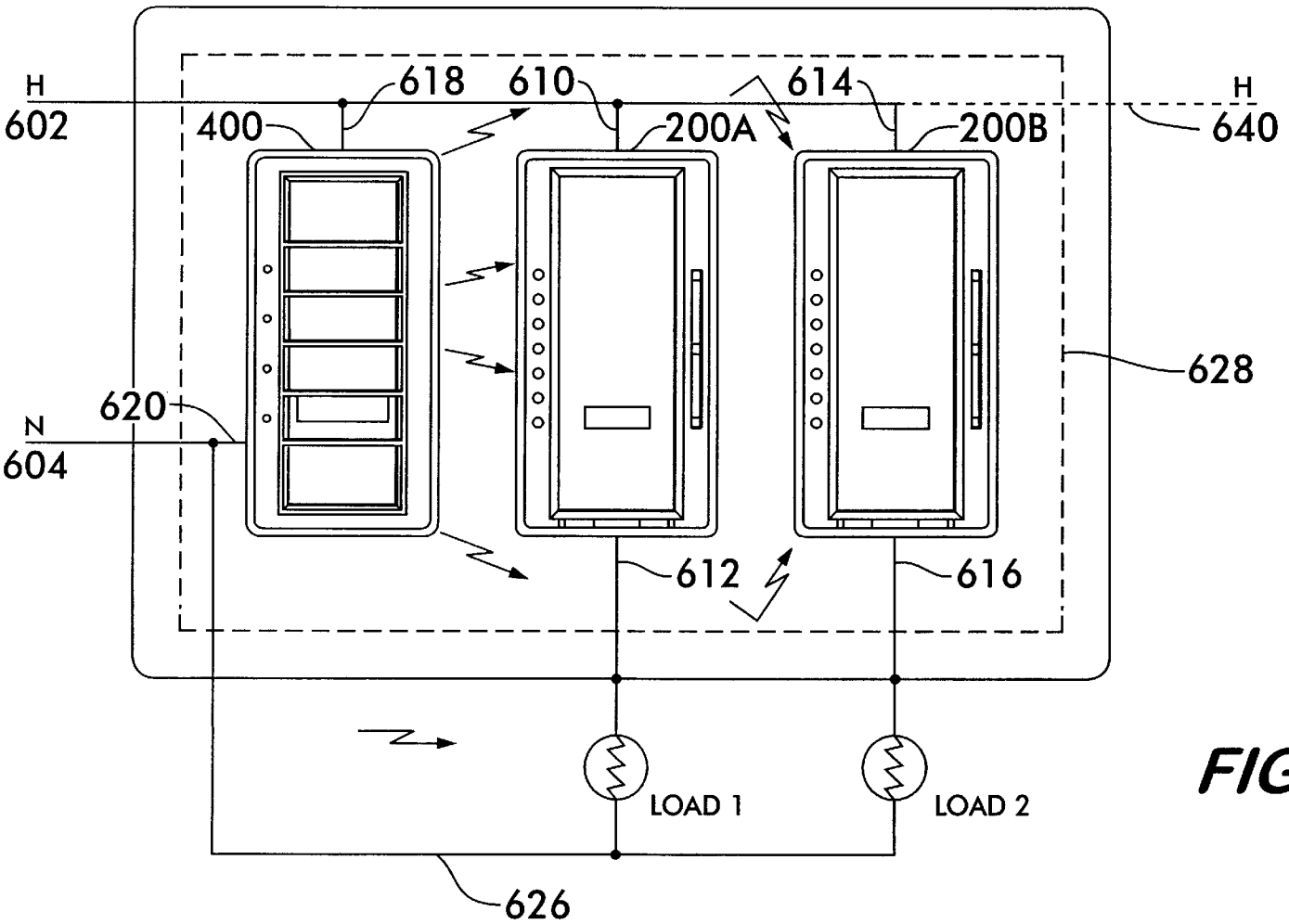
FIG. 8A shows the wall mountable dimmer and the wall mountable master control of the lighting control system of the present invention and how they are connected to the power source and the loads when some of the components are located in a common wallbox.

FIG. 8A shows the wiring to connect the dimmer 200A and 200B and the master control 400 to the power source (not shown) when all of the system components are located in a common 3 gang wallbox 628. The wallbox may be made of metal, plastic, or any other suitable material. The hot conductor 602 connects to hot conductor 618 of the master 400, lead 610 of the dimmer 200A, and lead 614 of dimmer 200B. Neutral conductor 604 connects to neutral conductor 620 of the master control 400 and 626 from one side of the load load 1 and load 2. The other side of each load is connected to dimmer 200A and 200B with conductors 612 and 616 respectively. A ground conductor is not shown for simplicity. The dimmer and master conductors could be replaced with suitable wire terminals. No conductor is required between the master control 400 and the dimmers 200A and 200B. FIG. 8A also shows an optional second hot feed 640. This optional second hot feed 640 enables one or more dimmers or the master control to be connected to different phases. The signals received by the dimmers are phase independent. No special circuitry is required in the dimmers if a master control and a dimmer are on different phases.

Figure 8B:
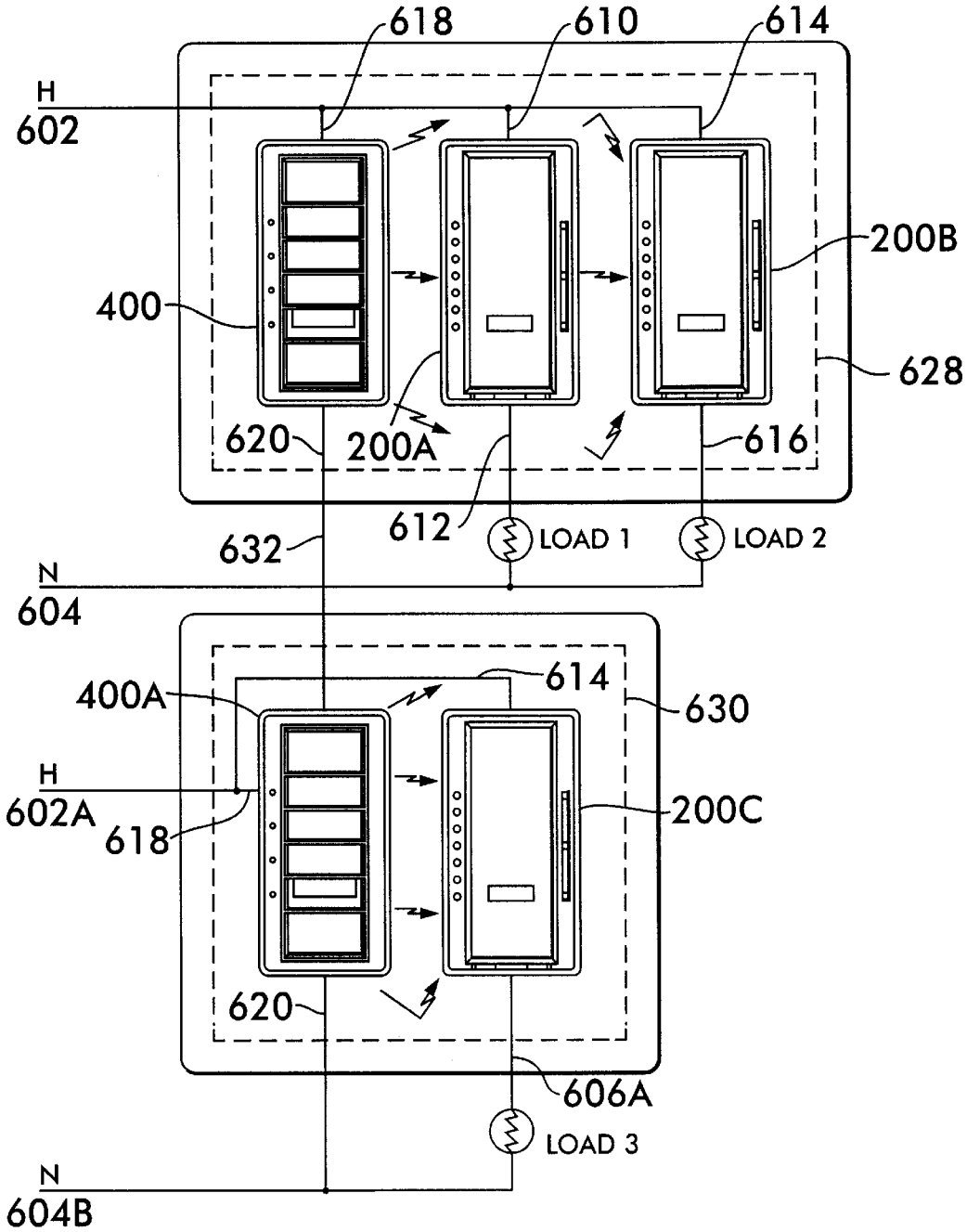
FIG. 8B shows the wall mountable dimmer and the wall mountable master control of the lighting control system of the present invention and how they are connected to the power source and the loads when some of the components are located in separate wallboxes.

FIG. 8B shows the wiring to connect the dimmers 200A, 200B and 200C and the master controls 400 and 400A to the power source (not shown) when some of the system components are located in separate wall boxes 628 and 630. The dimmers 200A and 200B and the master control 400 in the first wall box 628 are connected the same way as in FIG. 8A. The dimmer 200C and master 400A wire in a similar fashion. To send signals to the second wallbox 630 from the first wallbox 628 a cable must be run between the wallboxes. The cable can be an optical cable such as fiber optic conductor, a two conductor cable for transmitting low voltage analog or digital signals, a two conductor cable for transmitting infrared signals or a four wire RS485 conductor.

Figure 9:
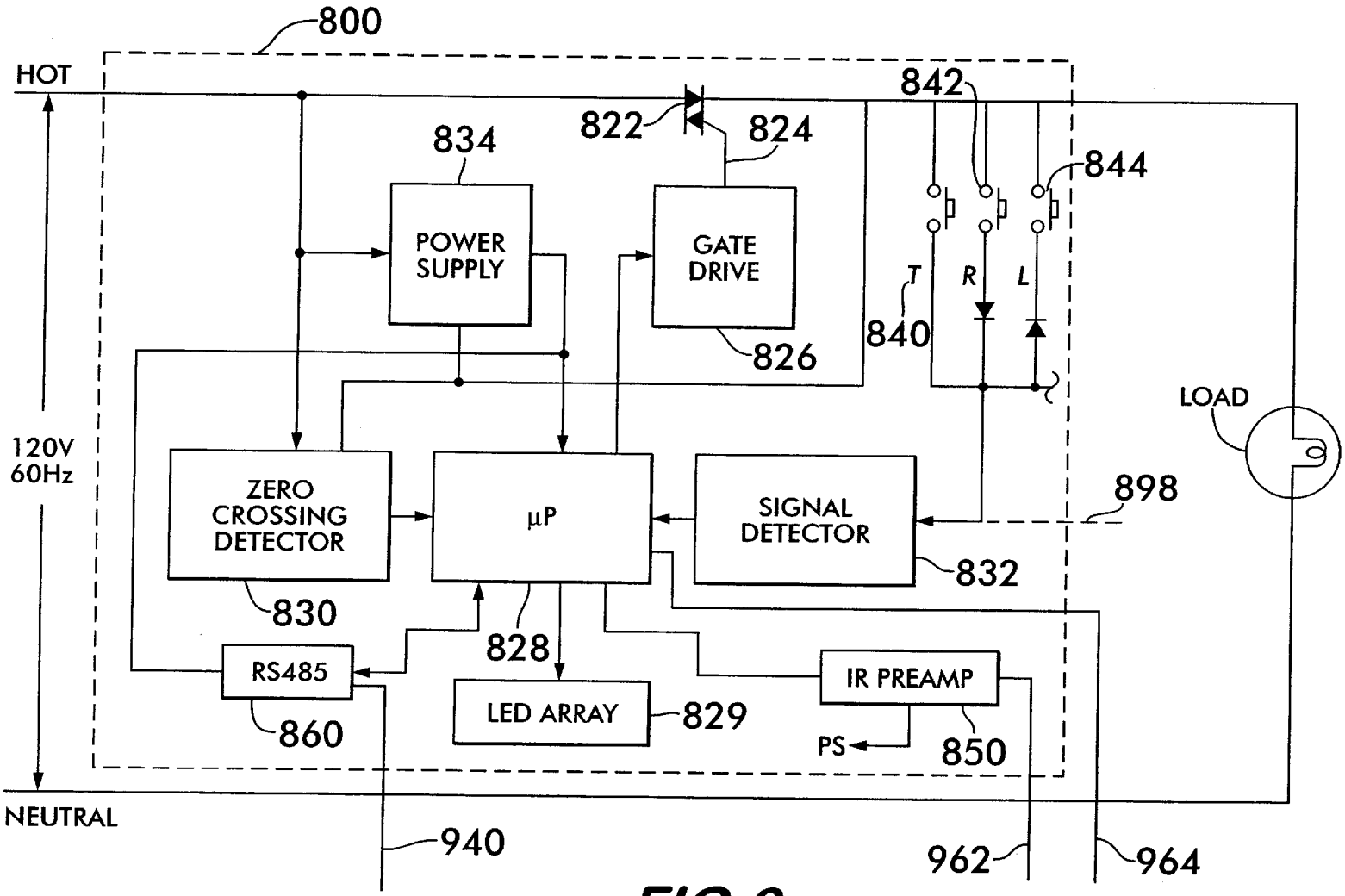
FIG. 9 shows a block diagram of the electrical components of the dimmer of FIG. 5A or 5B.

A block diagram of the control circuit 800 of the dimmer 200 or 300 is depicted in FIG. 9. The circuitry, with the exception of the RS485 link 860 is fully described in U.S. Pat. No. 5,248,919 and U.S. patent application Ser. No. 08/614,712 (now U.S. Pat. No. 5,909,087) which are both incorporated herein by reference. A suitable RS485 circuit is well within the capabilities of one skilled in the art. Therefore a detailed description of this circuit is not reproduced herein, and only the new features of the present invention are described below. This circuit 800 can be used both with the dimmers 200A and 200B shown in FIG. 5A and 5B. However, the program controlling microprocessor 828 is different from that in prior devices and provides additional functions and features not disclosed in the references. These features will be explained below.

FIG. 10 shows a block diagram of the control circuit 900 for the master control 400 as depicted in FIG. 6A and 6B. The control 900 connects to a power source which may be 24 VAC→120 VAC, for example. The control comprises a suitable isolated power supply 934 based on the power source, a microprocessor 928, an IR preamp 904, IR LED output 906, optional IR conductor 962, optional cable 960 with IR LED 964, Preset LEDs 929, local switches 910 and an RS485 circuit 908 which connects to other devices through cable 940. The local switches are actuated by actuators 422, 416A, 416B, 416C, 416D, 424, 414 (414A and 414B) as shown in FIG. 6A and 6B. In the preferred embodiment two microprocessors are used, they are a Motorola XC68HC705P6A and MC68H505KOP which could be combined into one microprocessor, and a suitable IR preamp is a Sony SBX8035-H. The RS485 circuit 908 is capable of sending and receiving signals between master controls 400 and 400A in conventional fashion. The master controls 400 and 400A can communicate to each other over a suitable cable 632 (FIG. 8B). Cable 632 could be optional IR conductor 962 or optional cable 960. The IR LED output 906 is used to blast IR signals to dimmers 200A and 200B located in the same wallbox (FIG. 8B). The IR LED output preferably comprises two IR LEDs located within the master control, with one LED facing towards the left, and one LED facing the right. The master control 400 is enclosed with an optically clear backcover (not shown) similar to the backcover for dimmers 200A and 200B. The IR signal from the IR LED output exits the master control 400 through the optically clear backcover and then enters the dimmers 200A and 200B through their optically clear backcovers or through the faceplate 212 and is detected by IR preamp 850 (Shown in FIG. 9.). The IR signal may bounce around in side the backbox 628.

Figure 11A:
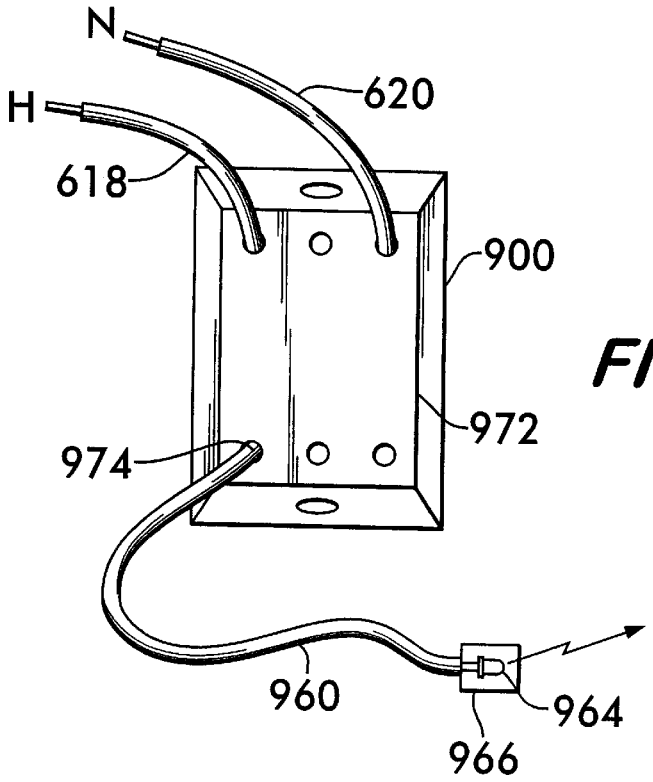
FIG. 11A shows details of a first embodiment of an electrical conductor.

FIG. 11A further shows an optional flexible cable 960 extending out of master control 900 through backcover 972. Cable 960 is an electrical cable containing two individual conductors (not shown). At the end of cable 960 is an infrared diode 964 encased in an optically clear enclosure 966. The infrared energy exits through the enclosure 966 which is spaced from the master control 900. The other end of the cable exits the backcover 972 through hole 974. FIG. 11A also shows the hot conductors 618 and the neutral conductor 620.

Figure 11B:
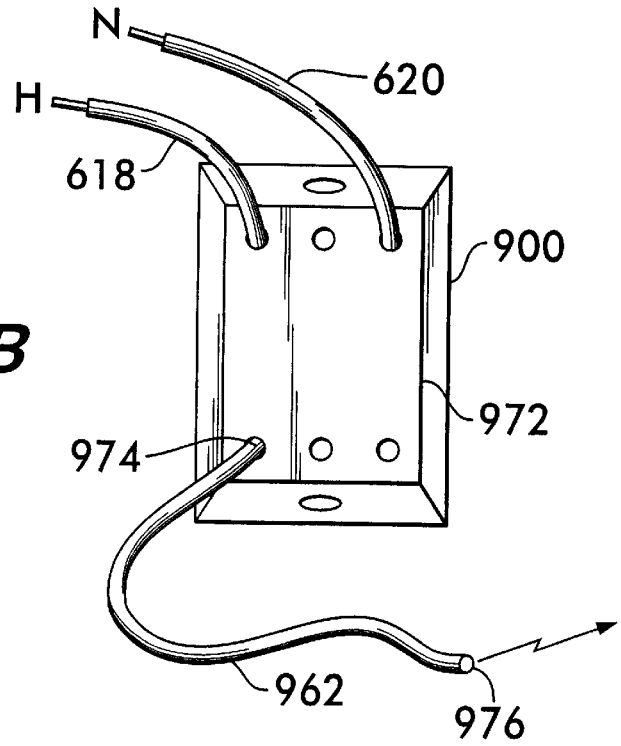
FIG. 11B shows details of a second embodiment of an infrared conductor.

FIG. 11B shows an optional second flexible cable 962 extending out of master control 900 through backcover 972. The cable is infrared transmissive. It can be made from an inexpensive hollow piece of flexible tubing, a more expensive fiber optic cable or any flexible infrared conductive material. The infrared energy exits through an end of the cable 976 spaced from the master control 900. The other end of the cable exits the backcover 972 through hole 974. FIG. 11B also shows the hot conductor 618 and the neutral conductor 620.

Figure 11C:
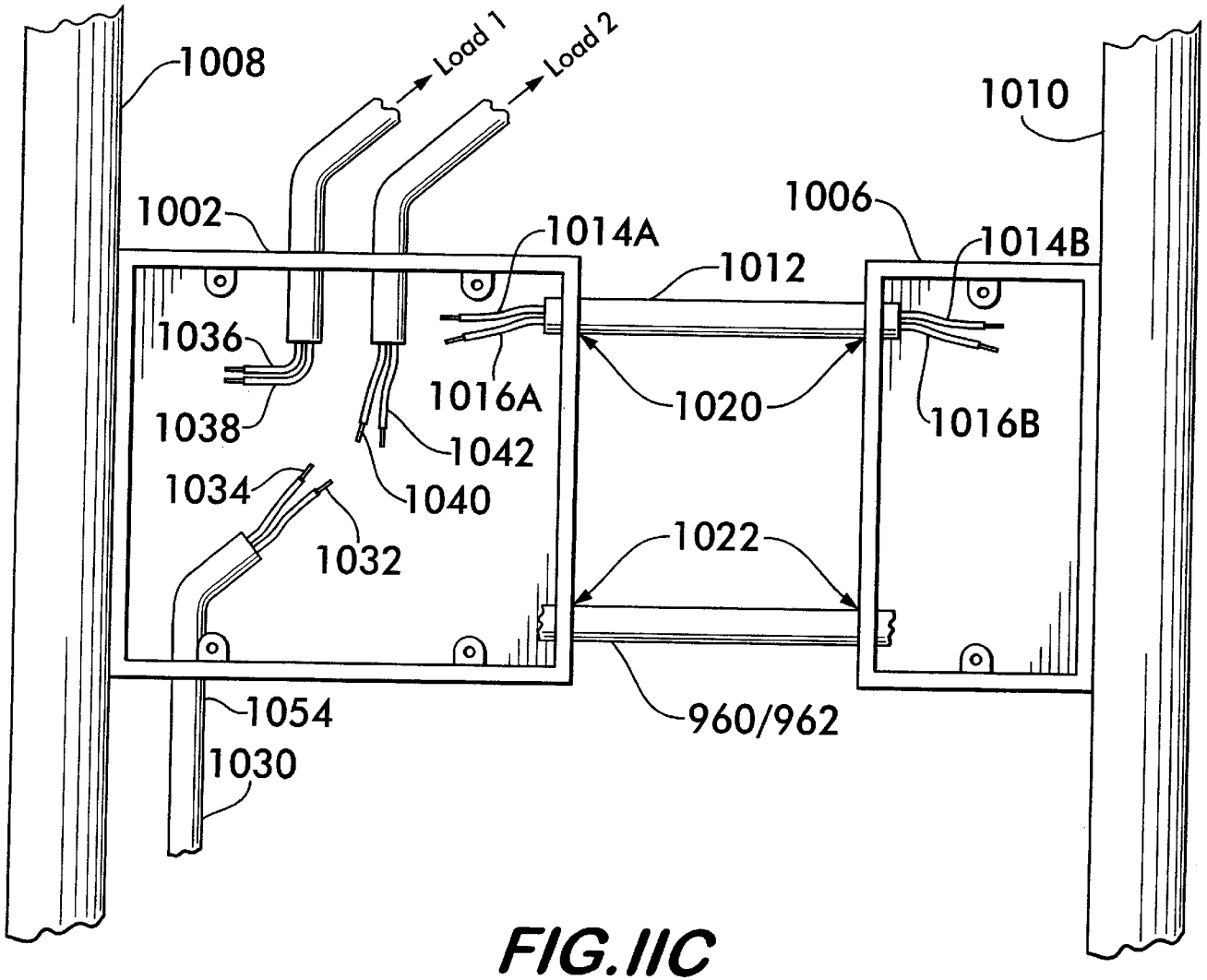
FIG. 11C shows two spaced electrical wallboxes and a communications cable connecting the two wallboxes.
Figure 12A:
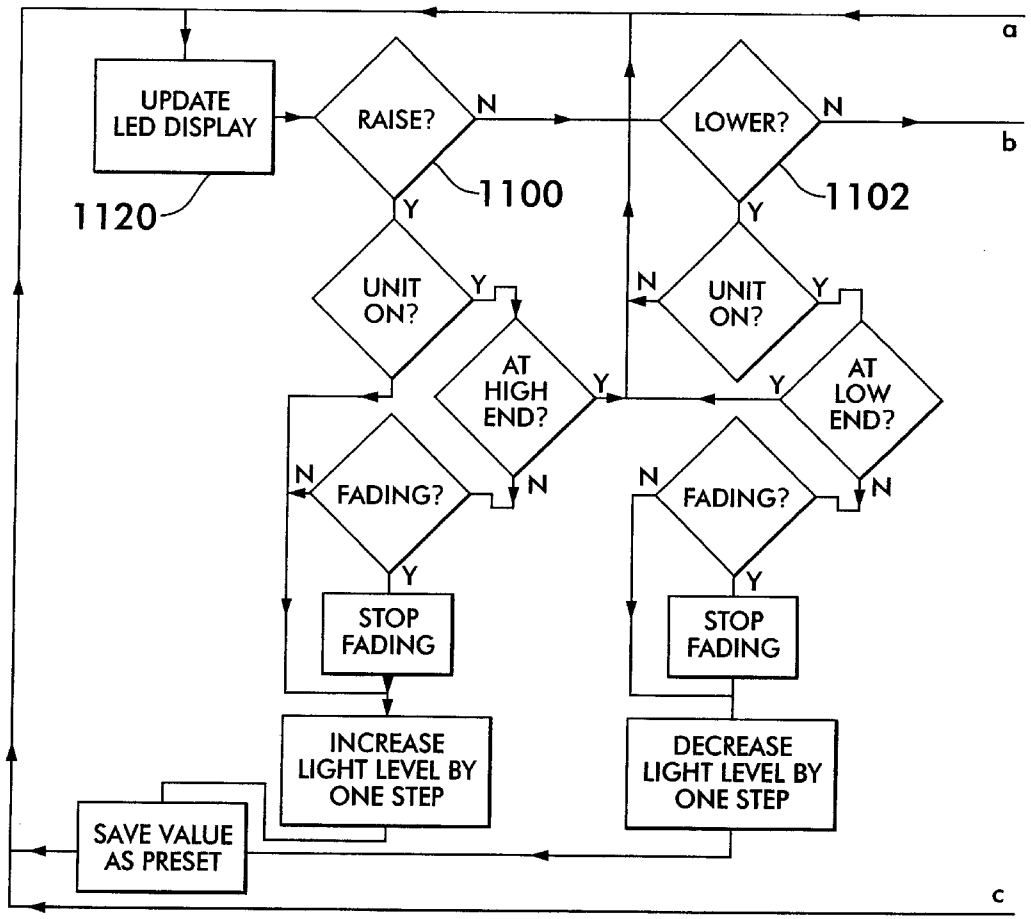
FIGS. 12A through 12D show a software flow chart for the dimmer of FIG. 5A or 5B.
Figure 12B:
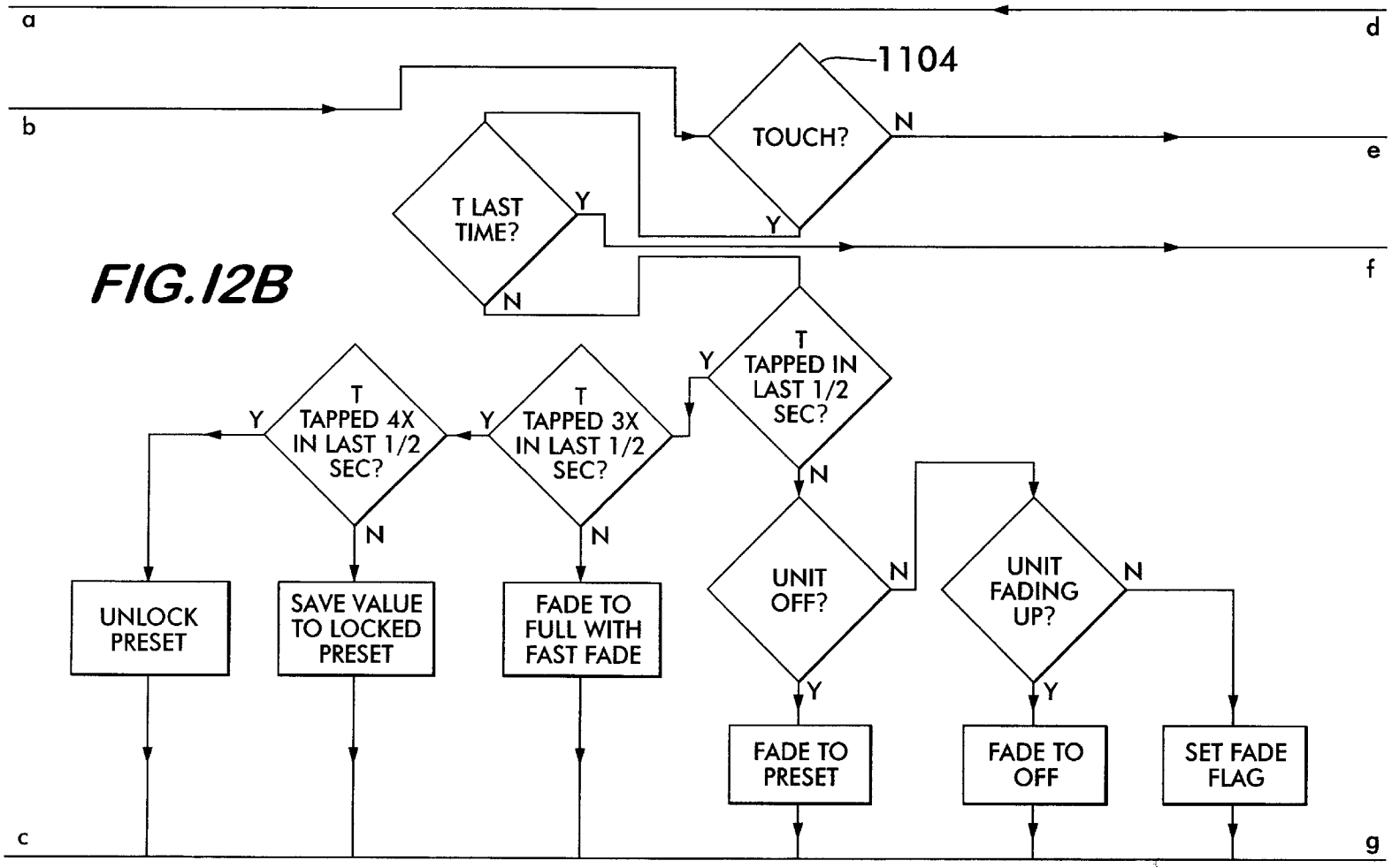
Figure 12C:
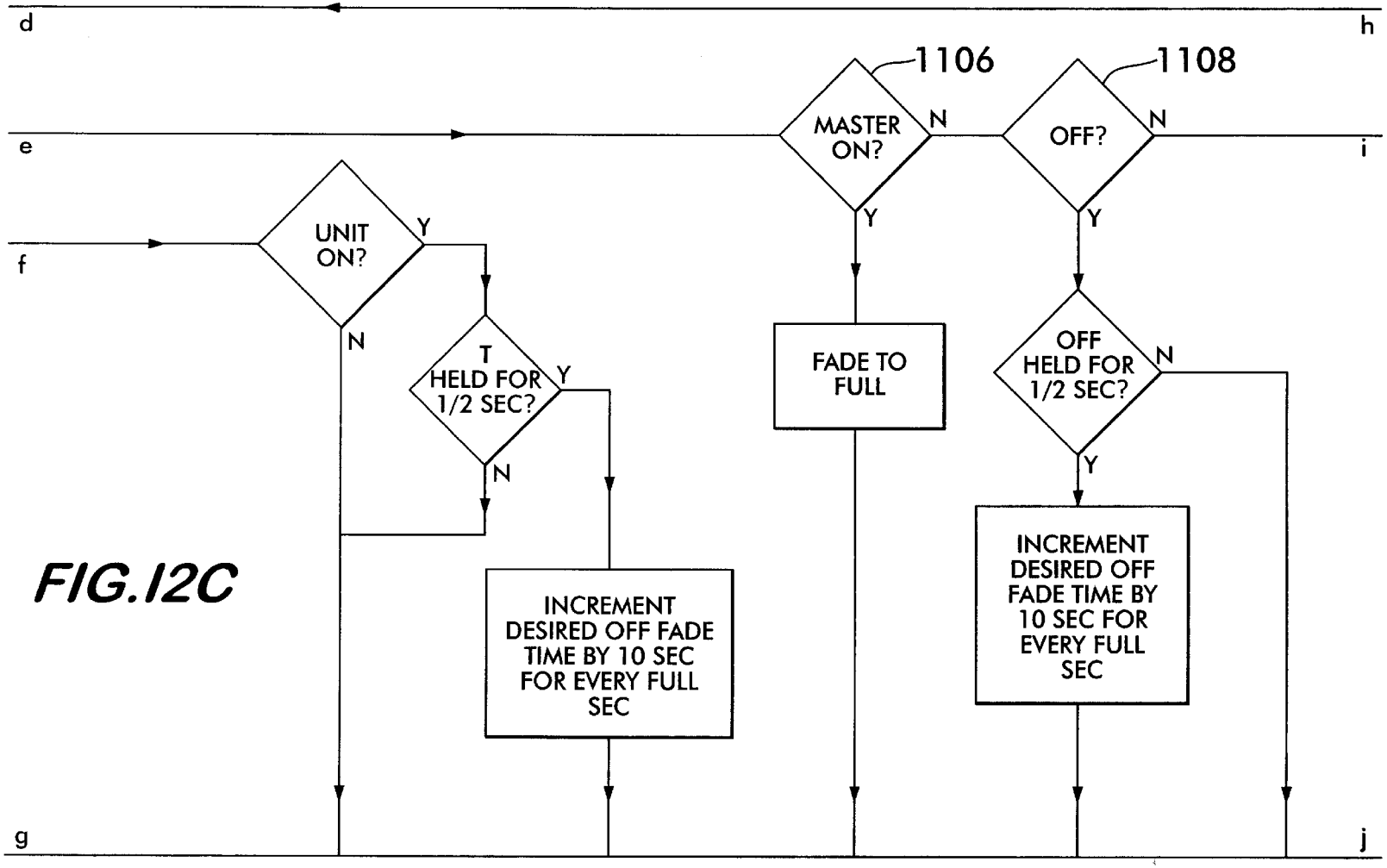
Figure 12D:
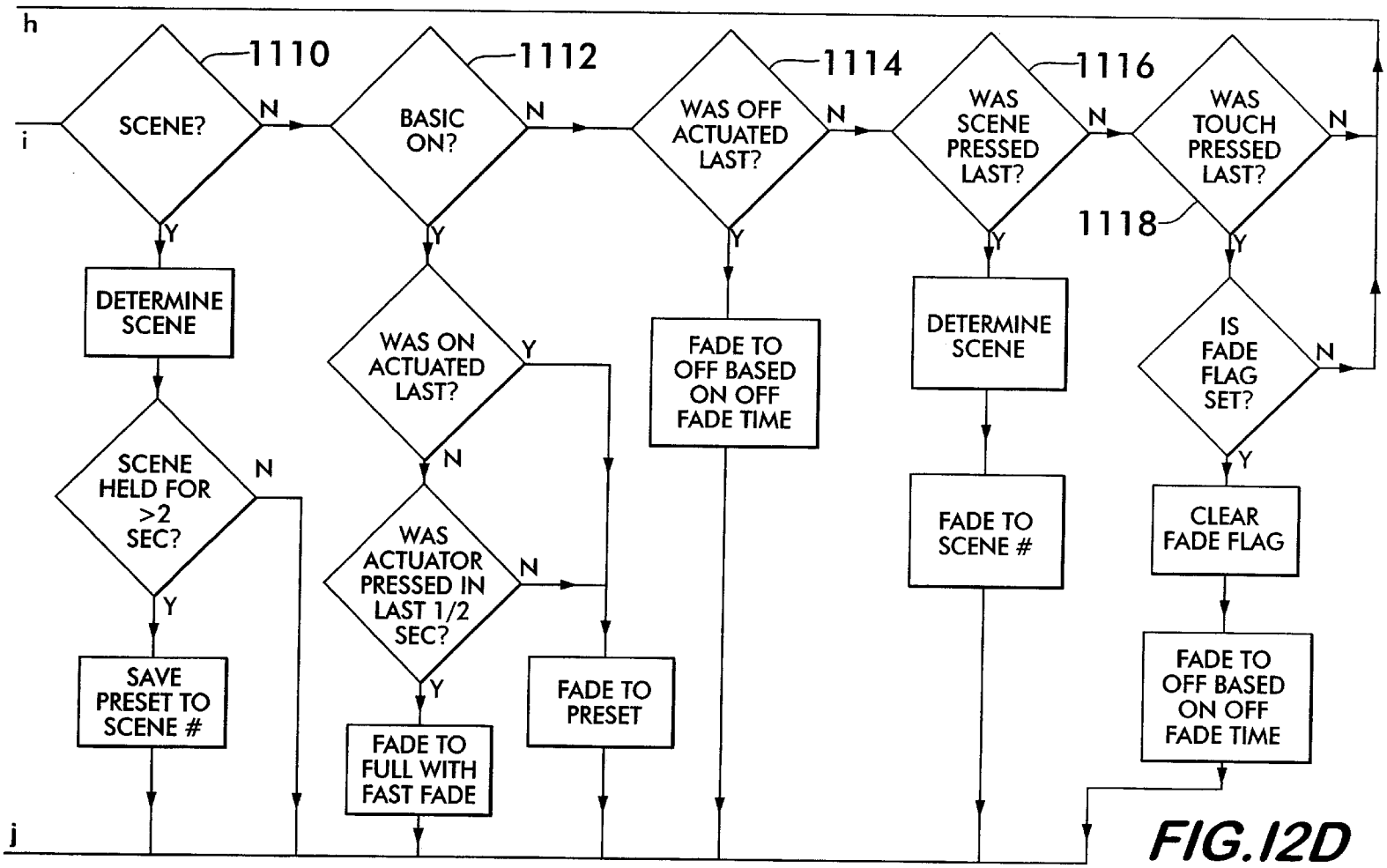

Both of these cables 960 and 962 are capable of being snaked from a first wallbox 1002 to a second separate wallbox 1006 (shown in FIG. 11C).

FIG. 11C shows a typical installation for the present invention. There are two wallboxes 1002 and 1006 shown secured to wall studs 1008 and 1010 respectively. Wallbox 1002 is shown as a two gang wallbox and wallbox 1006 is shown as a single gang wallbox. Wallbox 1002 could house two dimmers of the present invention and wallbox 1006 could house a master control of the present invention. When an electrician replaces two mechanical switches with two dimmers and a master control according to the present invention, an additional wallbox must be added in order to provide room for the master control. Wallbox 1002 is fed power from a power source (not shown) with cable 1030 which contains hot conductor 1034 and neutral conductor 1032 through a knockout 1054 in wallbox 1002. The power is connected to the dimmers and master control according to FIG. 8B. The hot conductor 1034 connects to a first lead 610 of the first dimmer 200A and the first lead 614 of the second dimmer 200B. The second lead 612 of the first dimmer 200A connects to the load LOAD 1 through dimmed hot conductor 1036. The second lead 616 of the second dimmer 200B connects to the load LOAD 2 through dimmed hot conductor 1040. Power from the loads LOAD 1 and LOAD 2 return through conductors 1038 and 1042 respectively and connect to neutral conductor 1032.

To provide power to the second wallbox 1010, an additional cable 1012 must be added which contains hot conductor 1014 and neutral conductor 1016. The cable enters each wallbox through knockouts 1020. One end 1014A of hot conductor 1014 connects with hot conductor 1034 in wallbox 1002 and the other end 1014B of hot conductor 1014 connects with master control lead 618 in wallbox 1006. One end 1016A of neutral conductor 1016 connects with neutral conductor 1032 in wallbox 1002 the other end 1016B of hot conductor 1016 connects with master control lead 620 in wallbox 1006.

Alternatively, the master control can be powered from a low voltage source [24 VAC] from a plug-in 120:24 v transformer.

A cable 632 must also be added between the wallboxes 1002 and 1006 to ensure communication between the master and the dimmers. The cable could be flexible cable 960 or 962 or any suitable cable such as a four conductor cable for transmitting RS485 signals. The cable enters each wallbox through knockouts 1022.

FIGS. 12A–D show a software flow chart for the dimmer 200. The dimmer can receive signals into the microprocessor 828 directly from the actuators 214A, 214B, or 216 operating their respective switches or from infrared signals received directly from a handheld infrared transmitters 600 or 700 or from the master control 400 through IR preamp 850.

When the dimmer 200 receives a RAISE command, block 1100, the dimmer 200 increases the light level by one step unless the dimmer 200 is at high end and then saves the new light level as PRESET. When the dimmer 200 receives a LOWER command, block 1102, the dimmer 200 decreases the light level one step unless the unit is at low end and then saves the new light level as preset.

When the dimmer 200 receives a TOUCH command, block 1104, the dimmer 200 can take one of several paths through the flow chart. A TOUCH command is received when actuator 216 is actuated, i.e., pressed and released. If the dimmer 200 is off and the TOUCH command is only received once, the dimmer fades to locked preset if there is one stored and if not the dimmer 200 fades to preset. If the unit is on and fading up and the TOUCH command is only received once, the dimmer fades to off. If the unit is on and not fading up and the TOUCH command is only received once, the dimmer sets a fade flag. Preset is the last light level the dimmer was set to. The set fade flag is necessary so that the dimmer will not start fading until the TOUCH actuator 216 is released. If the dimmer 200 determines that the TOUCH command has been received two times, but not three times in the last ½ second, the dimmer fades to full with fast fade. If the dimmer 200 determines that the TOUCH command has been received three times, but not four times in the last ½ second, the dimmer saves the present light level value as the locked preset. If the dimmer 200 determines that the TOUCH command has been received four times in the last ½ second, the dimmer unlocks the locked preset. If the dimmer 200 determines that the TOUCH actuator 216 is being held and the dimmer is off, the system returns to the beginning. If the dimmer 200 determines that the TOUCH actuator 216 is being held and the dimmer 200 is on, the system determines if the actuator 216 has been held for longer than a transitory period of time (greater an ½ second), if the answer is no, the dimmer 200 returns to the beginning. If the answer is yes, the dimmer 200 increments the desired off fade time by 10 seconds or every 1 second the actuator 216 is held.

When the dimmer 200 receives a MASTER ON command, block 1106, the dimmer automatically fades to full. The MASTER ON command can be sent from the actuation of actuator 422 from master 400 or actuator 522 from master 500.

When the dimmer 200 receives an OFF command, block 1108, the dimmer 200 determines if the actuator has been held for greater than ½ second. An OFF command can be sent from actuation of actuator 604 from transmitter 600, actuator 724 from transmitter 700, or actuation of actuator 424 from master control 400. If the answer is yes, the dimmer 200 increments the desired off fade time by 10 seconds or every 1 second the actuator is held. If no, the dimmer returns to the beginning.

When the dimmer 200 receives a SCENE command, block 1110, the dimmer 200 determines which scene actuator was actuated. A SCENE command can be sent from a transmitter 700 by actuation of actuators 718A, 718B, 718C, or 718D, or the master control 400 by actuation of actuators 416A, 416B, 416C, or 416D, or master control 500 by actuation of actuators 514A, 514B, 514C, or 514D. A master control, therefore, is not required in order to have an easy to program multiple preset lighting control system since transmitter 700 can be used. The dimmer next determines if the SCENE command has been held for greater than a 2 second, although any non transitory length of time will suffice. When a SCENE command is received for preferably greater than 2 seconds, the dimmer 200 saves the preset light level to the dimmer scene memory for that SCENE actuator. If the dimmer 200 determines that the actuator has been held for less than 2 seconds the dimmer 200 returns to the beginning.

When the dimmer 200 receives a BASIC ON command, block 1112, the dimmer determines if the BASIC ON command was actuated last. A BASIC ON command can be sent from actuation of actuator 602 from transmitter 600. The first time through the path the answer is no, so the dimmer 200 determines if the BASIC ON command was actuated within the last ½ second. The first time through this will also be no, so the dimmer 200 fades to preset. If the next time through the this path the dimmer 200 determines that the BASIC ON command was received the last time through the program loop, the dimmer 200 continues to fade to preset. If the dimmer 200 determines that the BASIC ON command has been actuated within the last ½ second, the dimmer 200 fades to full with fast fade.

When the dimmer 200 determines that the off actuator has been released, block 1114, the dimmer fades to off with the off fade time.

When the dimmer 200 determines that a scene actuator has been released, block 1116, the dimmer determines the scene and fades to that scene.

When the dimmer 200 determines that the touch actuator has been released, block 1118, the dimmer determines if the fade flag has been set. If no fade flag has been set, the dimmer returns to the beginning. If yes, the dimmer clears the fade flag and fades to off based on the off fade time.

Each loop through the flow chart, the dimmer updates the LED array 28, block 1120.

Figure 13:
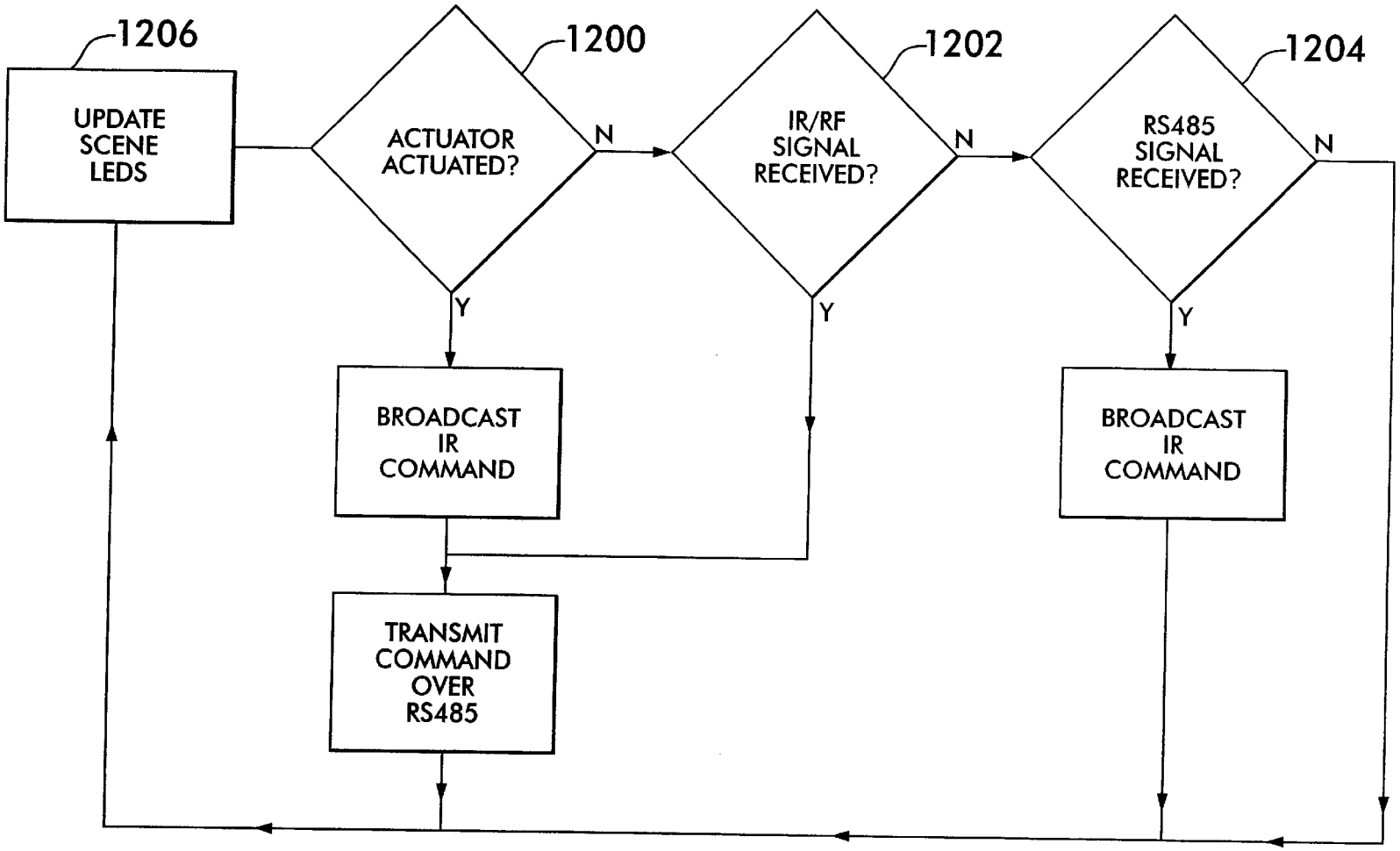
FIG. 13 shows a software flow chart for the master control of FIG. 6A or 6B.

FIG. 13 shows a software flow chart for a master control 400 or 500. The master 400 or 500 can receive signals into the microprocessor 928 directly from local switches 930, 932, 934, 936, 938, 940, 942, and 944, or from infrared signals received directly from a handheld infrared transmitters 600 or 700 through IR preamp 904 or from signals received through the RS485 circuit 908. When an actuator on the master control 400 or 500 is actuated, block 1200, the master control 400 or 500 broadcasts a command through the IR output LEDs 906 and optionally 964 to other master control or dimmers in the same or optionally a different wallbox. The master control 400 or 500 also transmits a command through the RS485 circuit to other master controls located in other wallboxes. The RS485 circuit is used to communicate signals over a greater distance than possible with infrared, for a less expensive communications mode or for more complex signals requiring higher transfer rates. The master control 400 or 500 then returns to the beginning.

When the master 400 or 500 receives a signal via infrared, block 1202 the master control 400 or 500 transmits a command through the RS485 circuit to other master control located in other wallboxes, but preferably does not broadcast a command through the IR output LEDs 906 and 964. An infrared signal can be received when actuators 602, 604, 614A, 614B, 718A, 718B, 718C, 718D, 714 or 724 are actuated from the infrared transmitter 600 or 700. The master control 400 or 500 does not send commands to the dimmers 200A and 200B that are received from transmitters 600 and 700. The dimmer 200A and 200B will receive and respond to these signals directly. The master control 400 or 500 lights the appropriate indicator 418A, 418B, 418C, 418D, or 518A, 518B, 518C, or 518D based on the preset command it receives from the transmitters 600 or 700 via infrared energy or by signals received through the RS485 circuit.

When the master control 400 or 500 receives a signal via the RS485 circuit 908, block 1204, the master control 400 or 500 simply broadcasts a command through the IR output LEDs 906 and 964 to other master control or dimmers in the same wallbox.

Each loop through the flow chart, the dimmer updates the LED, block 1206.

No preset values are saved in the master control 400 or 500, these preset values are stored in the corresponding dimmers 200A and 200B.

The present invention has been described as having a master control and one or more separate dimmers. In an alternative embodiment, the master control and a plurality of dimmers can be combined in a common enclosure like the system shown in FIG. 4.

The process of storing a preset power level according to the present invention is simple and straight forward. The user simply adjusts the light level of the load using an intensity selector and then actuates a preset actuator for a predetermined period of time, preferably a non-transitory period of time, more preferably for greater than 2 seconds. The preset can be recalled by actuating the preset actuator preferably for a transitory period of time, preferably less than 2 seconds, more preferably less than ½ second. The intensity of the load can be adjusted using an intensity selector 214 located on dimmer 200, an intensity selector 316A or 316B on dimmer 300, a master intensity selector 414 located on master control 400, a master intensity selector 522 or 524 located on master control 500, an intensity selector 614 located on transmitter 600, or an intensity selector 714 located on transmitter 700.

This process can be used to store individual preset light levels in a plurality of dimmer circuits controlled by individual intensity selectors. The preset light levels can be recalled by actuation of a single preset actuator. The intensity selectors and the preset actuator can be located in separate housing or in a common housing.

This process can also be used to store a plurality of preset light levels in single dimmer circuits controlled by a single intensity selector. The plurality of preset light levels can be recalled by actuation of any one of a plurality of preset actuators. The intensity selector and the preset actuators can be located in separate housings or in a common housing.

This process can further be used to store a plurality of preset light levels in a plurality of dimmer circuits controlled by a plurality of intensity selectors. The plurality of preset light levels can be recalled by actuation of any one of the plurality of preset actuators. The intensity selectors and the preset actuators can be located in separate housings or in a common housing.

This process allows the user to copy preset light levels from one actuator to another. This would be desirable by a user that wants to have two presets that are very similar, but not exactly the same. For example, in the first scene the user might want the light level of dimmer 1 at 85%, dimmer 2 at 65%, and dimmer 3 at 100% and in the second scene the user might want light level of dimmer 1 at 85%, dimmer 2 at 65%, abut dimmer 3 at 75%. With prior art systems, to store these light levels, the user would first have to actuate the first preset actuator, adjust each of the intensity selectors, and then store the light levels according to the prior art process. To store the second preset, the user would then actuate the second preset actuator and repeat the prior art process. The problem with these prior art systems is that as soon as the second actuator is actuated, the dimmers fade to their second preset light level. With the process according to the present invention, the user adjusts each of the three dimmers to the desired light level and then presses and holds the first preset actuator for a non-transitory period of time to save the three light levels as the first preset. To save the second preset, the user simply adjusts dimmer 3, the only dimmer who's light level needs to be changed, to the desired light level (75%) and then presses and holds the second preset actuator for a non-transitory period of time to save the three light levels as the second preset. The process of storing preset power levels according to the present invention can save considerable time.

Figure 14A:
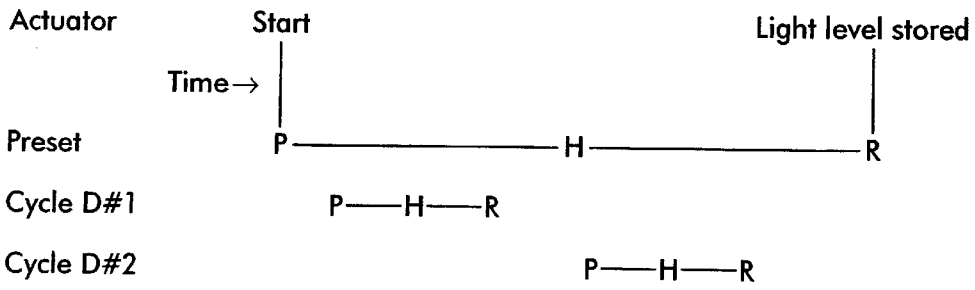
FIG. 14A PRIOR ART
FIGS. 14A through 14F show methods for storing a preset light level in wall box dimmer systems.

FIG. 14A shows the process for storing a preset light level in the system of the prior art known as Scene Select from Leviton Manufacturing Co. To store a preset the user presses (P) and Holds (H) the preset actuator to be programmed on the master control, presses (P) and Holds (H) a "cycle" actuator on the first dimmer (D#1) until the desired light intensity is reached, releases (R) the "cycle" button, and then releases (R) the preset actuator. The light intensity is stored in to memory when the preset actuator is released (R). A "Cycle" actuator on a second dimmer (D#2) can be actuated while the preset actuator is being held in order to store a preset value in the second dimmer (D#2) for recall from the same preset actuator.

Figure 14B:
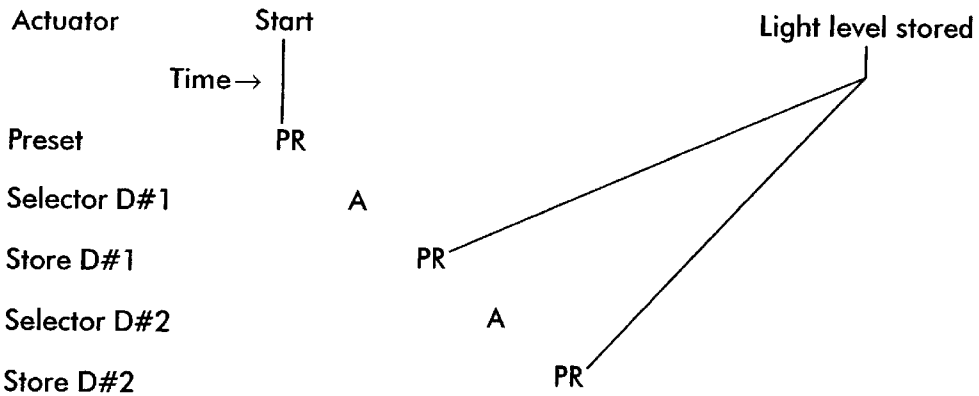
FIG. 14B PRIOR ART

FIG. 14B shows the process for storing a preset light level in the system of the prior art known as Multi-set from Lightolier Controls Inc. To store a preset the user presses and releases (PR) the preset actuator to be programmed on the master control, adjusts (A) the light level using a selector on the first dimmer (D#1), and then presses and released (PR) a store actuator on the dimmer (D#1). The light intensity is stored in to memory in the first dimmer (D#1) when the store actuator is pressed and releases (PR) on the dimmer (D#1). A preset can be stored in a second dimmer (D#2) for recall from the same preset actuator by adjusting (A) the selector on the second dimmer (D#2) and pressing and releasing (PR) the store actuator on the second dimmer (D#2). The light intensity is stored in to memory in the second dimmer (D#2) when the store actuator is pressed and released (PR) on the dimmer (D#2).

Figure 14C:
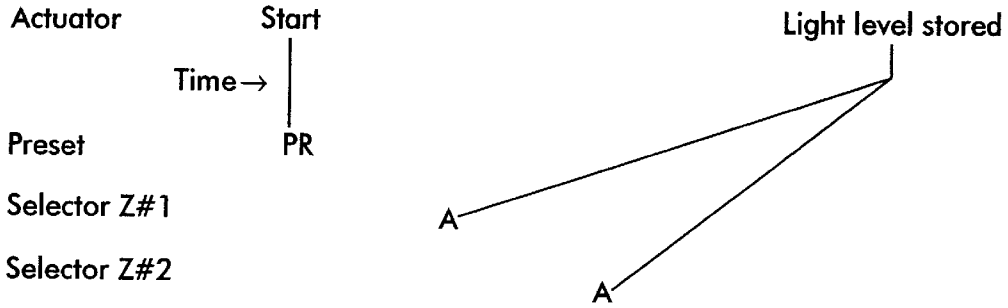
FIG. 14C PRIOR ART

FIG. 14C shows the process for storing a preset light level in a system known as Grafik Eye from the assignee of the present invention. To store a preset the user presses and releases (PR) the preset actuator to be programmed on the multi zone preset controller and adjusts (A) the light level using a selector (Z#1) controlling a first zone. The light intensity is automatically stored in to memory after the selector (Z#1) is released. A preset can be stored for a second zone for recall from the same preset actuator by just adjusting (A) the selector (Z#2) on the second zone.

Figure 14D:
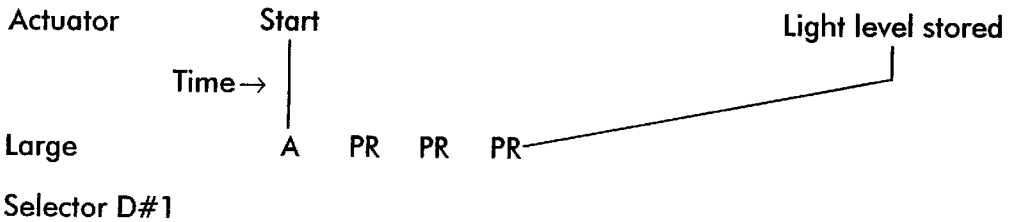

FIG. 14D shows the process for storing a locked preset light level in the system described in U.S. patent application Ser. No. 08/614,712 (now U.S. Pat. No. 5,909,087). To store a preset the user adjusts (A) the light level using a selector on the dimmer (D#1), and presses and releases (PR) a large actuator three times rapidly. The light intensity is stored in to memory when the third press and release (PR) is received in a ½ second time period. Only one preset can be locked in to memory.

Figure 14E:
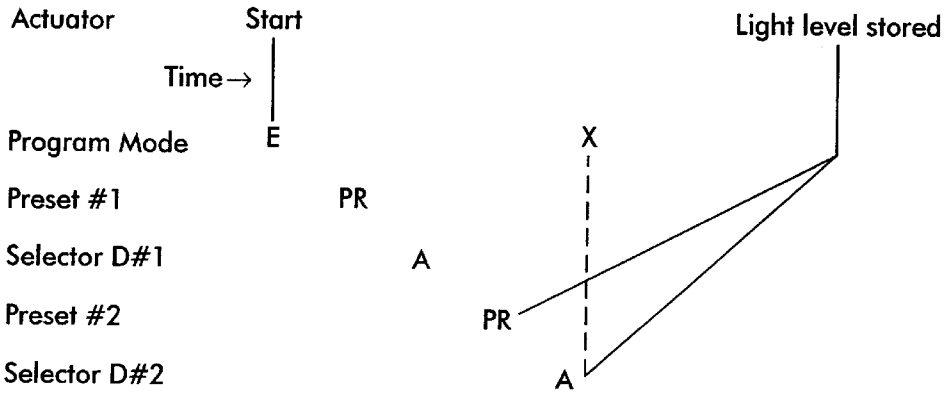

FIG. 14E shows another process for storing a preset light level in the system described in U.S. patent application Ser. No. 08/614,712 (now U.S. Pat. No. 5,909,087). To store a preset the user enters (E) a program mode by manipulating actuators on a hand-held infrared transmitter, presses and releases (PR) a preset actuator to be programmed on the transmitter, adjusts (A) the light level using a selector on the first dimmer (D#1) or on the transmitter, and presses and releases (PR) another preset actuator on the transmitter or exits (X) program mode. The light intensity is stored in to memory when another preset actuator is actuated or program mode is exited. A preset can be stored in a second dimmer (D#2) for recall from the same preset actuator by pressing and releasing (PR) another preset actuator while in programming mode, adjusting (A) the selector on the second dimmer (D#2) or on the transmitter and pressing and releasing (PR) another preset actuator on the transmitter or exiting (X) program mode.

Figure 14F:
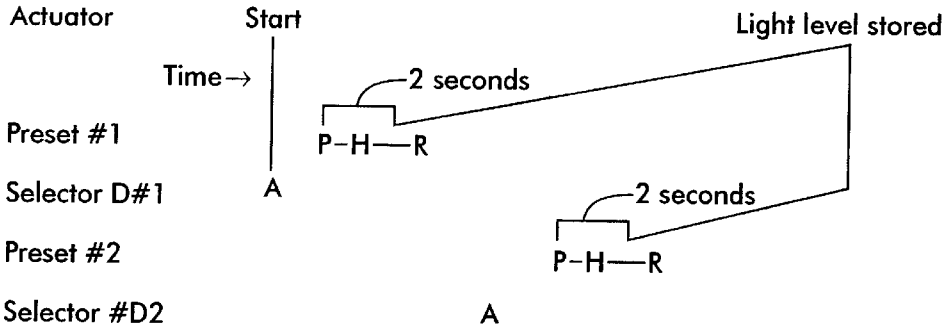

FIG. 14F shows the process for storing a preset light level in the system of the present invention. To store a preset the user adjusts (A) the light level using a selector on the first dimmer (D#1), on the master control or on a transmitter, and presses (P), holds (H), and releases (R) a preset actuator on the dimmer, transmitter, or master control. The actuator should be held for a non-transitory period of time. The light intensity is stored in memory after the preset actuator has been held for the non-transitory period of time, preferably 2 seconds. A preset can be stored in a second dimmer (D#2) for recall from a second preset actuator by adjusting (A) the light level using a selector on the second dimmer (D#2), on the master control or on a transmitter prior to pressing (P), holding (H), and releasing (R) the second preset actuator on the dimmer, transmitter, or master control. Once again, the light intensity is stored in memory after the preset actuator has been held for the non-transitory period of time. In an alternative embodiment of the invention, the light intensity level is stored in memory only after the applicable preset actuator has been released.

This invention has been described in specific embodiments, but the invention is not limited to those embodiments. The scope of the invention is limited only by the claims.

We claim:

1. A wallbox mountable lighting control device, comprising:

a. a plurality of lighting preset actuators;

b. an optically transparent backcover; and c. a radiation output device capable of outputting an IR signal within said wallbox relating to the actuation of at least one of said preset actuators; said radiation output device located interiorly of said backcover and oriented to transmit said IR signal through said backcover to be received exteriorly thereof.

2. The lighting control device of claim 1, wherein said radiation output device is an IR light emitting diode.

3. The lighting control device of claim 1, further comprising a radiation receiver for receiving IR signals, said radiation receiver being located within a second optically transparent backcover for receipt of the IR signal from said IR output device interiorly of said second backcover.

4. An electrical load control system comprising:

at least one dimmer control comprising an infrared input device for receiving an infrared control signal, the at least one dimmer control responsive to an infrared control signal for controlling power to be delivered to a load, the at least one dimmer control further comprising an optically clear backcover adapted to be received within a wallbox, the radiation input device being positioned interiorly of the backcover for receiving the infrared control signal through the backcover from exteriorly of the backcover;

an infrared output device capable of generating the infrared control signal, the infrared output device supported in light communication with the exterior of the backcover of the at least one dimmer control; and a master control electrically connected to the infrared output device for transmitting an electrical command signal to the infrared output device, the infrared output device responsive to the electrical command signal to generate the infrared control signal.

5. The electrical load control system according to claim 4 wherein the master control further comprises an optically clear backcover adapted to be received in the wallbox, the infrared output device being positioned interiorly of the master control backcover in light communication therewith for transmitting the infrared signal to the interior of the wallbox through the masts control backcover.

6. The electrical load control system according to claim 4 wherein the master control is located in a first wallbox and the infrared output device and the at least one dimmer control are located in a separate second wallbox, and wherein the electrical control system further comprises an elongated electrical conductor for conveying the electrical command signal, the electrical conductor having a first end electrically connected to the master control of the first wallbox and an opposite second end electrically connected to the infrared output device of the second wallbox, the infrared output device in light communication with the exterior of the dimmer backcover.

7. The electrical load control system according to claim 6 wherein the electrical conductor comprises an electrical cable having at least one conductive wire.

8. The electrical load control system according to claim 4 wherein the infrared output device comprises at least one LED.

9. The electrical load control system according to claim 8 wherein the infrared output device includes a pair of LEDs, the LEDs being oppositely directed with respect to one another to provide for broadcast of the infrared signal from the infrared output device in opposite directions within the wallbox.

10. The electrical load control system according to claim 4 wherein the master control and the infrared output device are located in a first wallbox and the at least one dimmer control is located in a separate second wallbox, and wherein the electrical load control system further comprises an elongated infrared conductor for conveying the infrared signal, the infrared conductor having a first end in light communication with the infrared output device of the first wallbox and an opposite second end in light communication with the exterior of the backcover of the at least one dimmer control of the second wallbox.

11. The electrical load control system according to claim 10 wherein the infrared conductor comprises a length of flexible tube.

12. The electrical load control system according to claim 10 wherein the infrared conductor comprises a fiber optic cable.

* * * * *